US007223508B2

(12) United States Patent
Nagase et al.

(10) Patent No.: US 7,223,508 B2
(45) Date of Patent: May 29, 2007

(54) TONER FOR DEVELOPING ELECTROSTATIC IMAGE, METHOD FOR PRODUCING THE TONER AND IMAGE FORMING METHOD

(75) Inventors: Tatsuya Nagase, Hachioji (JP); Asao Matsushima, Hachioji (JP); Naohiro Hirose, Hachioji (JP); Tomoe Kitani, Hachioji (JP); Ken Ohmura, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 283 days.

(21) Appl. No.: 10/805,956

(22) Filed: Mar. 22, 2004

(65) Prior Publication Data

US 2005/0208407 A1 Sep. 22, 2005

(51) Int. Cl.
*G03G 9/00* (2006.01)

(52) U.S. Cl. ..... 430/108.21; 430/110.4; 430/110.1

(58) Field of Classification Search ..... 430/108.21, 430/110.4, 110.1
See application file for complete search history.

(56) References Cited

U.S. PATENT DOCUMENTS 5,645,967 A * 7/1997 Sato et al. ..... 430/108.1
5,693,445 A * 12/1997 Yamaga et al. ..... 430/108.21
6,296,980 B1 10/2001 Oshiba et al.
6,455,215 B1 9/2002 Hashimoto et al.

FOREIGN PATENT DOCUMENTS

JP 62-278570 12/1987
JP 5-119532 5/1993
JP 7-295396 11/1995
JP 10-312088 11/1998
JP 10301333 A 11/1998
JP 11-258834 9/1999
JP 2000-214629 8/2000
JP 2000-292973 10/2000

(Continued)

OTHER PUBLICATIONS

Translation of JP 2003-167385.*

(Continued)

*Primary Examiner*—Mark A. Chapman
(74) *Attorney, Agent, or Firm*—Lucas & Mercanti, LLP

(57) ABSTRACT

The toner for developing an electrostatic image, includes a toner particle containing a binder resin and a colorant. The colorant has Feret's average horizontal diameter from 10 nm to 500 nm, and 50 number % or more of colorant has a Feret's horizontal diameter of from 2 nm to 300 nm. The colorant contains a compound represented by General Formula (1):

20 Claims, 10 Drawing Sheets

FOREIGN PATENT DOCUMENTS

| | | |
|---|---|---|
| JP | 2001-117269 | 4/2001 |
| JP | 2001-131214 | 5/2001 |
| JP | 2001-255703 | 9/2001 |
| JP | 2001-265067 | 9/2001 |
| JP | 2001-265145 | 9/2001 |
| JP | 2001-272819 | 10/2001 |
| JP | 2001-281927 | 10/2001 |
| JP | 2001-290302 | 10/2001 |
| JP | 2001-296692 | 10/2001 |
| JP | 2003-167385 | * 6/2003 |

OTHER PUBLICATIONS

Pigment Dictionary (Ganryo no Jiten) ( one page in Japanese).
Chemical Comprehensive Dictionary (Kagaku Daijiten) (one page in Japanese).
Declaration of Mr. Yamazaki; copy in Japanese of JP2001-370029; English Translation.

* cited by examiner

TONER PARTICLE HAVING NO CORNERS

TONER PARTICLE HAVING CORNERS

TONER PARTICLE HAVING CORNERS

TONER FOR DEVELOPING ELECTROSTATIC IMAGE, METHOD FOR PRODUCING THE TONER AND IMAGE FORMING METHOD

BACKGROUND

1. Technical Field

The present invention relates to a toner for developing an electrostatic image, a method for producing the toner and an image forming method.

2. Description of Related Art

In recent years, with the requirement of high image quality, a technology for forming a toner particle having a small particle size is making progress. However, it has been found that when the particle size is made small, resolution or sharpness of a full color image is surely satisfied to some degree but a variety of influences are exerted accompanying the minimization of the particle size. In addition, there arises a problem that as the toner particle is made smaller, charging property is more easily affected due to uneven distribution of colorants constructing the toner.

As a conventionally known toner with a small particle size, U.S. Pat. No. 6,296,980 (Japanese Patent Application Publication-Tokukai-2000-214629) discloses that a polymerized toner produced by a suspension polymerization or an emulsion polymerization can be controlled in the toner particle size or shape in a polymerization process in an aqueous medium, so that a toner having a small particle size, a unified particle size distribution and a round shape with no corners on the particle can be obtained. The polymerized toner has been noticed as a toner which makes it possible to reproduce a small dot image for a digital image due to the thin line reproducibility and high resolution thereof.

However, the polymerized toner tends to be inferior to a pulverized toner in dispersibility of colorants added in the toner. For example, in the case of producing the polymerized toner using the suspension polymerization, pigments as a colorant are dispersed in monomers and then the resultant dispersion is polymerized, however, there is a problem in that since viscosity of monomer droplets is easily increased with progress of the polymerization, coagulation of the colorant easily occurs. Further, in the case of producing the polymerized toner using the emulsion polymerization, there is a problem in that coagulation of the colorant is accelerated due to pH in an association process, namely, in a coagulation process, therefore, coagulation of the colorant easily occurs.

As described above, the polymerized toner has a problem that in the production process of the toner, coagulation of the colorant is liable to occur, as a result, dispersibility is easily deteriorated.

Particularly, in a multicolor image forming process, transparency is required in order to superimpose a plurality of color toners to form color images. In particular, when forming images on an OHP film, adequate transparency becomes a serious problem.

Further, when dispersibility of the colorant is poor, odor emitted from the toner as a final product is affected in some cases and therefore, improvement in dispersibility of the colorant is desired also from this point of view.

Further, after suspending an image forming apparatus under a high temperature and high humidity environment for a long period of time, there is caused a mixed state of a toner changed in the charge amount due to moisture absorption and a new toner, as a result, irregular density is generated on a half tone image having a halftone dot. In addition thereto, in the multicolor image forming process, a colorant added in the toner of developers of each color exerts an influence, as a result, a difference is caused in developing properties between the developers of each color, which incurs widening of color difference.

At present, in view of the above-described problems, there has been demanded a toner having more excellent dispersibility of a colorant in the toner and exhibiting more balanced hue than a conventional color toner.

In particular, as a magenta colorant, conventionally known are various ones such as azo lake pigments, anthraquinone dyes, quinacridone pigments, rhodamine dyes and lake pigments of these. Among these, there is desired a colorant which exhibits good chromaticity and has high heat resistance, low fog, good transmittance in OHP, and no odor when incorporated into the toner.

As to a technique for utilizing a conventionally known magenta colorant, for example, U.S. Pat. No. 6,455,215 (Japanese Patent Application Publication-Tokukaihei-9-179348) discloses a technique for utilizing as a colorant a magenta toner comprising C.I. Pigment Red 122, C.I. Pigment Red 57:1 or C.I. Pigment Red 81 (rhodamine dye) in which the magenta toner is used at a specific ratio in a binder resin, whereby light resistance or copy storage ability as a defect of rhodamine dyes is enhanced and narrow color reproduction area as a defect of azo lake pigments is improved.

Further, Japanese Patent Application Publication-Tokukaihei-10-312088 discloses a full-color image forming toner in which C.I. Pigment Red 122 and C.I. Pigment Red 57:1 as a magenta toner, C.I. Pigment Blue 15:3 as a cyan toner and C.I. Pigment Yellow 180 as a yellow toner each is used as a colorant, whereby color reproduction area is sufficiently improved and color image storage ability is improved.

However, it is still the case that even using the above-described magenta colorants, there is not obtained a toner which exhibits good chromaticity and has high heat resistance, low fog, good transmittance in OHP, and no odor when incorporated into the polymerized toner.

SUMMARY

In accordance with the first aspect of the invention, a toner for developing an electrostatic image, comprising a toner particle containing a binder resin and a colorant, wherein a Feret's average horizontal diameter of the colorant is from 10 nm to 500 nm, a ratio of the colorant having the Feret's horizontal diameter of from 2 nm to 300 nm is 50% by number or more, and the colorant contains a compound represented by a following General Formula (1) or a lake of the compound:

General Formula (1)

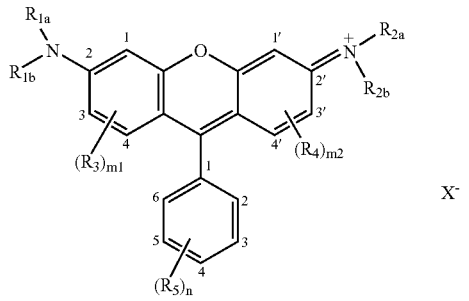

[wherein $R_{1a}$, $R_{1b}$, $R_{2a}$ and $R_{2b}$ each represents a hydrogen atom, an alkyl group having from 1 to 5 carbon atoms and a fluoroalkyl group having from 1 to 5 carbon atoms, $R_3$ and $R_4$ each represents a hydrogen atom, an alkyl group having from 1 to 5 carbon atoms and a fluoroalkyl group having from 1 to 5 carbon atoms, $R_5$ represents a hydrogen atom, an alkyl group having from 1 to 5 carbon atoms, a fluoroalkyl group having from 1 to 5 carbon atoms, an alkoxyl group having from 1 to 5 carbon atoms, a halogen atom, a cyano group, a nitro group, a sulfo group, an alkali earth metal salt or higher amine salt having a sulfo group, N-phenylamino-sulfonyl group, a carboxyl group, an alkali earth metal salt or higher amine salt having a carboxyl group, N-phenylcarbamoyl group, an ureylene group, an iminodicarbonyl group, an alkoxycarbonyl group, —$CONHR_6$ (wherein $R_6$ represents a hydrogen atom, an alkyl group having from 1 to 8 carbon atoms or a phenyl group), —$NHCOR_7$ (wherein $R_7$ represents an alkyl group) or —$SO_2R_8$ (wherein $R_8$ is an alkyl group having from 1 to 8 carbon atoms), m1 and m2 each represents an integer of 1 to 5, n represents a number of 1 to 5, and $X^-$ represents an anion].

In accordance with the second aspect of the invention, an image forming method comprises:

visualizing an electrostatic latent image formed on a photoreceptor, with the above-described toner;

transferring the visualized image onto a recording medium; and carrying out a heat fixation of the transferred image.

A toner for developing an electrostatic image, which exhibits good chromaticity and has high heat resistance, low fog, good transmittance in OHP, and no odor; a method for producing the toner; and an image forming method can be provided.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein.

DETAILED DESCRIPTION

Figure 1A:
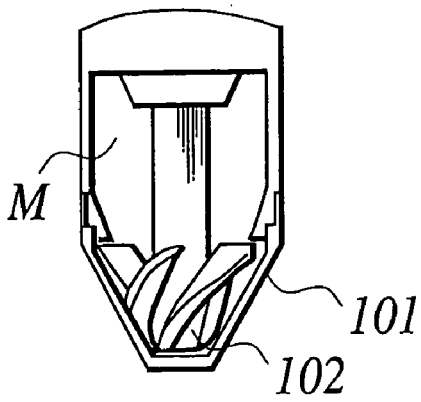
FIGS. 1A, 1B and 1C show examples of a dispersion apparatus used for obtaining the colorant.

As a result of extensive investigations so as to solve the above-described problems, the inventors have found that in an electrostatic image developing toner having a toner particle containing a binder resin and a colorant, when a Feret's average horizontal diameter of the colorant is 10 nm to 500 nm, the ratio of the colorant having a Feret's horizontal diameter of 2 nm to 300 nm in all the particles of the colorant is 50% by number or more, and the colorant contains a compound represented by the General Formula (1), there can be provided a toner for developing an electrostatic image, which exhibits good chromaticity and has high heat resistance, low fog, good transmittance in OHP, and no odor; a method for producing the toner; and an image forming method.

<<Colorant>>

The colorant is described.

The essential requirements of one exemplary the colorant are that a Feret's average horizontal diameter is from 10 nm to 500 nm, a ratio of the colorant having a Feret's horizontal diameter of 2 nm to 300 nm in all the particles of the colorant is 50% by number or more, and the colorant contains a compound represented by the General Formula (1).

From the viewpoint of further preferably obtaining the effect described in the present invention, the Feret's average horizontal diameter of the colorant is preferably from 50 nm to 300 nm. Further, the ratio of the colorant having the Feret's horizontal diameter of from 2 nm to 300 nm in the toner particles is preferably 60% by number or more, more preferably from 80% by number to 100% by number.

<<Feret's Horizontal Diameter of Colorant>>

The Feret's horizontal diameter represents a length in the horizontal direction of the particle at the time of horizontally placing the toner particle in an arbitrary state. The Feret's horizontal diameter of the colorant represents a length in the horizontal direction of each colorant existing inside the toner particle arbitrarily placed as described above. In addition, the Feret's average horizontal diameter of the colorant is an average in the Feret's horizontal diameters of at least 100 colorants in the toner particles.

From the viewpoint of suppressing occurrence of offset, the variation coefficient of the Feret's horizontal diameter of the colorant inside the toner particle according to the present invention is preferably 40% or less, more preferably 35% or less, particularly preferably 30% or less. The variation coefficient of the Feret's horizontal diameter of the colorant inside the toner particle is obtained by the following formula.

Variation coefficient of Feret's horizontal diameter={S2/K2}×100(%)

wherein S2 represents a standard deviation of the Feret's horizontal diameter of 100 colorants, and K2 represents an average of the Feret's horizontal diameters.

The variation coefficient of the Feret's horizontal diameter of the colorant inside the toner particle represents a variation in averages of the Feret's horizontal diameters, that is, a variation in the size of the domain containing the colorant in the case where a binder resin is defined as a matrix.

The effect described in the present invention can be further preferably obtained when the variation coefficient becomes 40% or less, however, it is not necessarily that a value of this variation coefficient is zero, that is, the Feret's horizontal diameters have no variation.

Data of the above-described Feret's average horizontal diameter, Feret's horizontal diameter, etc. of the colorant in the toner particle can be obtained by observation, photograph of particles and image analysis using a conventionally known transmission electron microscope apparatus. Observation is sufficiently performed by using a transmission electron microscope commonly known among those skilled in the art. For example, transmission electron microscopes such as LEM-2000 (manufactured by Topcon Co., Ltd.) and JEM-2000FX (manufactured by JEOL Ltd.) are used.

Data of Feret's horizontal diameter, Feret's average horizontal diameter, etc. are calculated from the results of the transmission electron microscope photograph, such as the number of the domain in the toner particle, determined based on the projection plane of 1,000 or more toner particles photographed with a magnitude of 10,000 times.

The photographing by use of the transmission electron microscope is performed in the commonly known manner for measuring the toner particle. More specifically, the cross-section of the toner particle may be concretely measured in the following manner:

The toner particle is sufficiently dispersed in epoxy resin hardenable at an ordinary temperature and embedded in the resin by hardening, or the toner is dispersed in a fine powder of styrene resin having a particle size of about 100 nm and pressed to form a block, and the block obtained is dyed by triruthenium tetraoxide or triosmium tetraoxide or a combination thereof, according to necessity, and the block is sliced by a microtome having a diamond cutting edge to prepare a thin sliced sample. The sliced sample thus prepared is photographed by the transmission electron microscope (TEM) to take a photograph of the cross-section of the toner particle. From the obtained picture, the shape of the area of the crystalline compound in the toner particle is visually confirmed and the values of Feret's average horizontal diameter, Feret's horizontal diameter, number and shape coefficient of the colorant existing as the domain inside the toner particle is obtained by processing the image information of the taken photograph by the use of an image processing apparatus "Lusex F" (manufactured by Nicole Co., Ltd.), attached to the electron microscope apparatus.

As the colorant for the toner, a colorant (also referred to as a colorant fine particle) dispersed in an aqueous dispersion medium in a state of a fine particle having a weight average particle size of 2 nm to 300 nm is used during the production process of the toner. The colorant is added into the toner particles and is preferably dispersed in a range of from 2 nm to 200 nm.

The "aqueous dispersion medium" as used herein means a medium comprising 50% by mass to 100% by mass of water and 0% by mass to 50% by mass of a water-soluble organic solvent. Examples of the water-soluble organic solvent include methanol, ethanol, isopropanol, butanol, acetone, methyl ethyl ketone and tetrahydrofuran. Of these, preferred is an alcohol based organic solvent which does not dissolve the obtained resins. Further, the weight average particle size of the colorant dispersed in the form of a fine particle in the aqueous dispersion medium can be measured employing an electrophoretic light scattering photometer "ELS-800" (manufactured by Ohtsuka Denshi Co.).

A method for preparing the colorant into the fine colorant particle having the above-described weight average particle size is described in detail below.

[Production of Fine Colorant Particle]

Figure 1B:
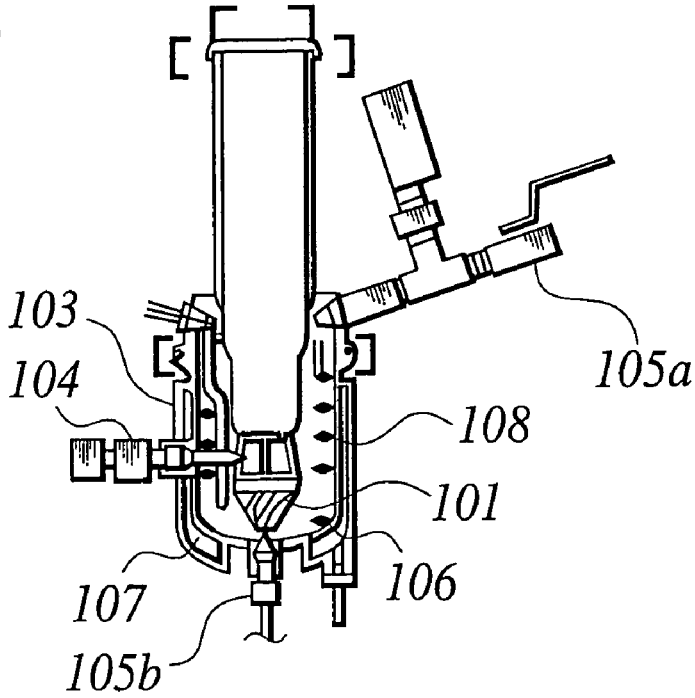
Figure 1C:
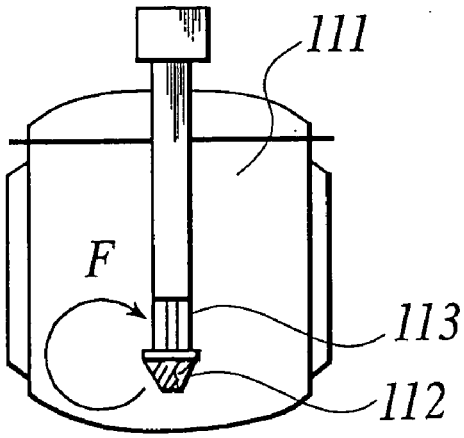

Fine colorant particles employed for obtaining the toner of the present invention are formed by use of a dispersion apparatus for finely dispersing the fine colorant particles in an aqueous medium containing a surfactant. Specifically, the dispersion apparatus shown in FIGS. 1A to 1C is one example of dispersion apparatuses for finely dispersing the fine colorant particles preferably used in the toner of the present invention. In the dispersion apparatus, a shearing force is generated by use of a screen to compartmentalize the stirring chamber and a rotor rotated at a high speed in the stirring chamber, and by the action of the shearing force (and the action of impact force, pressure variation, cavitation, and potential core), the colorant is finely dispersed in an aqueous medium containing a surfactant to obtain fine colorant particles.

Herein, the surfactant incorporated in an aqueous medium to disperse the fine colorant particles is dissolved in concentration higher than or equal to the critical micelle concentration (CMC). The surfactant used may be the same as those used in the above-described polymerization process.

The weight average particle size (being the dispersed particle size) of the fine colorant particle is commonly from 2 nm to 300 nm, is preferably from 2 nm to 200 nm. When the weight average particle size of the fine colorant particle is less than 10 nm, flotation of the colorant in an aqueous medium becomes active, while when the weight average particle size thereof exceeds 300 nm, the colorant particle is easily sedimented without being properly dispersed in the aqueous medium. As a result, introduction of the colorant into the toner particle becomes difficult and the fine colorant particle remains free in the aqueous medium without being taken into the toner particle. Thus, either case is not preferred.

Fine colorant particles employed in the toner of the present invention are prepared as follows. After a colorant is charged into an aqueous medium comprising surfactants, preliminary dispersion (coarse dispersion) is initially carried out employing a propeller stirrer to prepare a preliminary dispersion liquid in which coagulated particles of the colorant are dispersed. The resultant preliminary dispersion liquid is supplied to a stirring apparatus provided with a screen to compartmentalize the stirring chamber and a rotor rotated at a high speed in the stirring chamber and is subjected to a dispersion treatment (being a fine dispersion treatment), employing the stirring apparatus, whereby a dispersion liquid comprising fine colorant particles in a preferred dispersion state is prepared.

In the present invention, listed as the stirring apparatus for a dispersion treatment to prepare fine colorant particles in a preferred dispersion state may be "CLEARMIX" (manufactured by M Tech Co., Ltd). The "CLEARMIX" comprises a high speed rotating rotor (a stirring blade), and a fixed screen (a fixed ring) surrounding the rotor, and has a structure which applies the action of shearing force, impact force, pressure variation, cavitation, and potential core to the treated composition. The treated composition is effectively emulsify-dispersed utilizing synergistic functions generated by these actions.

Namely, the "CLEARMIX" is originally used to prepare an emulsion (being a dispersion of fine liquid particles). However, the present inventors have found that a dispersion liquid of fine colorant particles having a preferred average particles size as well as a markedly narrow size distribution, was prepared employing the "CLEARMIX" as an apparatus to disperse solid fine colorant particles into an aqueous medium.

FIG. 1A is a schematic view showing a high speed rotating rotor and a fixed screen surrounding the rotor. In FIG. 1A, numeral 101 indicates a screen and M indicates a stirring chamber compartmentalized by the screen 101, and numeral 102 indicates a high speed rotating rotor in the stirring chamber M.

The rotor 102 is a high speed rotating stirring blade. Its rotational frequency is commonly from 4,500 rpm to 22,000 rpm, and is preferably from 10,000 rpm to 21,500 rpm. The peripheral speed of the tip of rotor 102 is commonly from 10 m/second to 40 m/second, and is preferably from 15 m/second to 30 m/second.

The screen 101 provided around the rotor 102 comprises a fixed ring constituted of many slits (not shown). The slit width is commonly from 0.5 mm to 5 mm, and is preferably from 0.8 mm to 2 mm. Further, the number of slits is commonly from 10 to 50, and is preferably from 15 to 30. The clearance between the rotor 102 and the screen 101 is commonly from 0.1 mm to 1.5 mm, and is preferably from 0.2 mm to 1.0 mm.

The average particle size of fine colorant particle as well as the particle size distribution is adjusted by controlling the rotational frequency of the rotor 102, and further, may be adjusted by selecting the shape of the screen 101 as well as the rotor 102. Specifically, the preferred dispersion state is obtained by combinations of the screen (S1. 0–24, S1. 5–24, S1. 5–18, S2. 0–18, and S3. 0–9) provided as standard equipment in the "CLEARMIX" and the rotor (R1 through R4). However, a further preferred state may be obtained utilizing an apparatus prepared by an operator.

FIG. 1B is a schematic view showing a continuous type processing apparatus (CLEARMIX) provided with the rotor as well as the screen. A preliminary dispersed dispersion liquid (being a preliminary dispersion liquid) is supplied from a preliminary dispersion inlet 104, shown in FIG. 1B, to a stirring chamber between the screen 101 and the rotor. The screen 101 as well as the rotor is surrounded by a pressurized vacuum attachment 103, and a thermal sensor 106, a cooling jacket 107, and a cooling coil 108 are arranged. Colorant coagulated particles in the preliminary dispersion liquid are provided with a shearing force generated by the high speed rotating rotor and the screen 101, and thereby pulverized (finely dispersed).

Namely, colorant coagulated particles in the preliminary dispersion liquid, supplied into the belt-shaped stirring chamber provided between the screen 101 and the rotor, are subjected to a shearing force (mechanical energy) generated by the screen 101, and the high speed rotation of the rotor, and in addition to the shearing force, the action of a collision force, pressure variation, cavitation, and potential core, so as to be pulverized (finely dispersed), whereby fine colorant particles are formed. The dispersion liquid comprising the fine colorant particles is spouted into the pressurized vacuum attachment 103 through the slits of screen 101. As a result, obtained is a dispersion liquid comprising fine colorant particles, having a preferred average particle size as well as a narrow particle size distribution. The dispersion liquid comprising fine colorant particles is conveyed from a dispersion liquid outlet 105*a* to the next process.

Reference numeral 105*b* is a drain separately provided as an outlet of the dispersion liquid. The colorant coagulated particles are pulverized by the action of the rotor and screen in the stirring apparatus so as to form fine colorant particles (dispersed particles) having a preferred average particle size as well as a narrow range of the particle size distribution. The formation mechanism of the fine colorant particles will be explained based on a plurality of actions described below.

(1) Since in a portion near the surface of a high speed rotating rotor (being a stirring blade), the speed gradient is large, a high speed shearing region is formed at the portion near the surface. As a result, the colorant coagulated particles are pulverized by the shearing force generated in the region.

(2) At the rear of the rotor (being a stirring blade), when the rotor rotates at a high speed, a vacuum region (cavitation) is generated. Air bubbles generated by the rotation are eliminated at the stage where the flow rate of the dispersion liquid decreases. At the same time, along with the compression of the air bubbles, impact pressure is generated. The colorant coagulated particles are pulverized by the resulting impact pressure.

(3) When the rotor (being a stirring blade) is rotated at a high speed, the preliminary dispersion liquid is provided with pressure energy. When the resulting pressure energy is rapidly released, the motion energy of the preliminary dispersion liquid is increased. When the preliminary dispersion liquid, which is scattered by the rotor, repeatedly passes between the releasing section (slit section) and the tightly closed section (non-slit section), the resulting pressure energy varies. As a result, pressure waves are generated, thereby pulverizing the colorant coagulated particles.

(4) When the preliminary dispersion liquid, having a large motion energy, collides with the screen or other walls, the colorant coagulated particles, which are subjected to the resulting collision force, are pulverized, whereby fine colorant particles are prepared which have a narrow range of the particle size distribution.

(5) When a dispersion liquid having a high velocity energy passes through the slit sections of the screen, a jet flow is formed. In the potential core (a velocity region which is not affected by the action of a viscous flow) in the jet flow, the surrounding flow is sucked in at a high speed. The colorant coagulated particles, which are subjected to the resulting energy, are pulverized, whereby fine colorant particles, having a narrow range of the particle size distribution, are prepared.

The dispersion time to prepare a fine colorant particle dispersion liquid is not particularly limited, however, is commonly from 5 minutes to 30 minutes, and is preferably from 7 minutes to 25 minutes. Further, when circulated, at least 5 passes are preferred, and 5 passes to 20 passes are more preferred. It is not preferable that the dispersion time is excessively long, because dispersion is excessively carried out and the existing amount of fine particles becomes greater than desired.

In order to prepare fine colorant particles preferably usable for the toner of the present invention, a batch type dispersion process may be carried out in which a dispersion vessel provided with a stirring apparatus, having the screen and the rotor, is employed, and a colorant (being an aqueous medium comprising a colorant) is spouted into the aqueous medium housed in the dispersion vessel from the stirring chamber of the stirring apparatus.

FIG. 1C is a schematic view showing a dispersion vessel provided with the stirring apparatus (CLEARMIX), and the dispersion process is carried out employing the apparatus. In FIG. 1C, numeral 111 is a dispersion vessel, 112 is a stirring apparatus, and 113 is a stirring shaft to drive the stirring apparatus 112. The stirring apparatus 112 has the same construction (the screen and the rotor) as that shown in FIG. 1A.

The preliminary dispersion liquid (being a colorant coagulated particle dispersion liquid) is introduced into the stirring chamber from the upper section of the stirring apparatus 112 and is stirred utilizing a strong shearing force generated between the high speed rotating rotor and the screen, an impact force, and a turbulent flow, whereby fine colorant particles, having a weight average particle size of 30 nm to 300 nm, are formed, which are then spouted into the dispersing vessel 111 from the slits of the screen. In the dispersion process of fine colorant particles, the dispersion vessel 111 is subjected to a jacket structure and the temperature of the interior of dispersion vessel 111 may be controlled by flowing heated water, steam, and if desired, by flowing cold water.

When the dispersion process is carried out employing the dispersion vessel shown in FIG. 1C, the spouting direction (the spouting direction of fine colorant particles into the aqueous medium) of the colorant from the stirring chamber of the stirring apparatus 112 is preferably in a downward or horizontal direction. By spouting the colorant (being fine colorant particles) in the downward or horizontal direction, the aqueous medium in the dispersion vessel 111 flows as shown by arrow F. As a result, the colorant is spouted downward, and the resulting flow rises along the wall and is circulated again to CLEARMIX. Due to that, it is possible to assuredly repeat the dispersion process, and it is also possible to uniformly provide dispersion energy to the colorant. As a result, it is assumed that it is possible to render the dispersed colorant particle size uniform. As described above, it is possible to effectively form fine colorant particles having a narrow range of particle size distribution.

As described above, colorant particles preferably employed in the present invention are prepared by pulverizing colorant coagulated particles, utilizing the action of a shearing force generated by the screen and the rotor. As a result, a dispersion liquid is prepared which comprises fine colorant particles (fine particles near primary particles) having a suitable average particle size (a weight average particle size: from 30 nm to 500 nm) as well as a narrow range of particle size distribution (having a standard deviation, ($\sigma$) of less than or equal to 30). Such fine colorant particles (dispersion particles) are subjected to salting-out/fusion with fine resinous particles. As a result, the fine colorant particles are assuredly introduced into the interior of the resulting toner particle. Introduced colorant particles are not dislodged so that no fluctuation occurs with regard to the content ratio of the colorant in each of the toner particles.

As a result, even when images are formed, employing the resulting toner, which has been stored under a high temperature and high humidity, of the present invention, or employing an image forming apparatus which has not been operated over an extended period of time, image problems such as fog due to the variation of charge amount of the toner and dust of minute dots do not occur. Further, since fine colorant particles are dispersed in the toner particle without using any media, image problems due to minute residual impurities such as crushed pieces of media in the toner do not occur.

The colorant particles are subjected to salting out/fusion process in a state that they are dispersed in aqueous medium. The aqueous medium to disperse the colorant particles is preferably an aqueous solution dissolving a surfactant in concentration not less than critical micelle concentration (CMC).

Dispersion machines employed in the dispersion of the colorant particles are not particularly limited, however, preferred examples include pressure dispersion machines such as "CLEARMIX" (manufactured by M Tech Co., Ltd) which is a stirring apparatus equipped with a high speed rotating rotator, ultrasonic dispersion machines, mechanical homogenizers, Manton-Gaulin homogenizers and pressure type homogenizers, and medium dispersion machines such as GETSMAN MILL and DIAMOND FINE MILL.

In order to simultaneously carry out salting-out and fusion of composite resin particles and colorant particles, it is required that salting agent (coagulant) is added to the dispersion of composite resin particles and colorant particles in an amount not less than critical coagulation concentration and the resulting dispersion is heated to the glass transition temperature (Tg) or higher of the composite resin particles.

Suitable temperature for salting out/fusion is preferably from (Tg+10° C.) to (Tg+50° C.), and more preferably from (Tg+15° C.) to (Tg+40° C.). In addition, an organic solvent which is dissolved in water infinitely may be added in order to conduct the fusion effectively.

Further, after preparing colored particles (in the present invention, called toner particles) upon salting out, aggregation, and fusion resin particles and colorants in an aqueous medium, separation of the toner particles from the aqueous medium is preferably carried out at a temperature of not lower than the Krafft point of the surfactants in the aqueous medium, and is more preferably carried out in the range of the Krafft point to the Krafft point+20° C.

The Krafft point, as described herein, refers to the temperature at which an aqueous solution comprising a surfactant starts to become milky-white. The Krafft point is measured as follows.

<<Measurement of Krafft Point>>

A solution is prepared by adding a coagulant in a practically employed amount to an aqueous medium employed in salting-out, aggregation, and fusion processes, namely, a surfactant solution. The resulting solution is stored at 1° C. for 5 days. Subsequently, the resulting solution is gradually heated while stirring until it becomes transparent. The temperature, at which the solution becomes transparent, is defined as its Krafft point.

From the viewpoint of minimizing excessive static charge to toner particles and providing uniform electrostatic property to the toner particles, particularly in order to stabilize electrostatic property against ambience, as well as to maintain the resulting electrostatic property, the electrostatic image developing toner preferably comprises the above-described metal elements (listed as such forms are metals and metal ions) in an amount of 250 ppm to 20,000 ppm in the toner and more preferably in an amount of 800 ppm to 5,000 ppm.

The compound represented by the General Formula (1) or a lake of the compound is described.

An alkyl group having 1 to 5 carbon atoms represented by $R_{1a}$, $R_{1b}$, $R_{2a}$, $R_{2b}$, $R_3$ and $R_4$ in General Formula (1), may be unsubstituted or may have a substituted group. Examples thereof include a methyl group, ethyl group, isopropyl group, propyl group, butyl group and pentyl group.

Among these, preferably used is a compound that either one of $R_{1a}$ and $R_{1b}$ is a hydrogen atom and the other one is an ethyl group, and/or either one of $R_{2a}$ and $R_{2b}$ is a hydrogen atom and the other one is an ethyl group.

Examples of the fluoroalkyl group having from 1 to 5 carbon atoms represented by $R_{1a}$, $R_{1b}$, $R_{2a}$, $R_{2b}$, $R_3$ and $R_4$ in General Formula (1) include a methyl group, ethyl group, isopropyl group, propyl group, butyl group and pentyl group each having at least one fluorine atom. The above-described groups may further have a substituted group.

Among the alkyl groups having from 1 to 5 carbon atoms represented by $R_3$ and $R_4$ in General Formula (1), preferably used is a methyl group, and particularly preferably used are a methyl group on the 3-position as $R_3$, and a methyl group on the 3'-position as $R_4$.

An alkyl group having from 1 to 5 carbon atoms and a fluoroalkyl group having 1 to 5 carbon atoms each represented by $R_5$ in General Formula (1) are synonymous with the group represented by the above-described $R_{1a}$, $R_{1b}$, $R_{2a}$, $R_{2b}$, $R_3$ and $R_4$.

An alkoxyl group represented by $R_5$ in General Formula (1) may be unsubstituted or may have a substituted group. Examples thereof include a methoxy group, ethoxy group, propoxy group, isopropoxy group and butoxy group.

Examples of the halogen group represented by $R_5$ in General Formula (1) include a fluorine atom, a chlorine atom, a bromine atom and an iodine atom.

Examples of the higher amine salts having a sulfo group represented by $R_5$ in General Formula (1) include amines having 4 or more carbon atoms such as butyl amine, cyclohexyl amine, naphthyl amine, aniline, anisidine, phenetidine, toluidine and xylidine.

Examples of the higher amine salts having a carboxyl group represented by $R_5$ in General Formula (1) include amines having 4 or more carbon atoms such as butyl amine, cyclohexyl amine, naphthyl amine, aniline, anisidine, phenetidine, toluidine and xylidine.

Examples of the alkoxycarbonyl group represented by $R_5$ in General Formula (1) include a methoxycarbonyl group, an ethoxycarbonyl group, a propoxycarbonyl group and a butoxycarbonyl group. Among these, preferably used is a methoxycarbonyl group, and it is more preferably substituted to 2-position, and a methoxycarbonyl group 2-position substituted is particularly preferable.

Examples of the alkyl group having from 1 to 8 carbon atoms represented by $R_5$ in —$CONHR_5$ group represented by $R_5$ in General Formula (1) include a methyl group, ethyl group, propyl group, pentyl group, hexyl group and octyl group.

Examples of the alkyl group represented by $R_6$ in —$NHCOR_6$ group represented by $R_5$ in General Formula (1) include a methyl group, ethyl group, propyl group, pentyl group, hexyl group, octyl group and decyl group.

Examples of the alkyl group having from 1 to 8 carbon atoms represented by $R_7$ in —$SO_2R_7$ group represented by $R_5$ in General Formula (1) include a methyl group, ethyl group, propyl group, pentyl group, hexyl group and octyl group.

Examples of the anions represented by $X^-$ in General Formula (1) include sulfate, perchlorate, tetraphenylborate, benzenesulfonate, p-toluenesulfonate and halogen ion.

Further, as for a lake of the compound represented by General Formula (1), preferred is a lake pigment which is prepared by subjecting the compound represented by the General Formula (1) to salt formation and insolubilization with phosphotungstic acid, phosphomolybdic acid or a complex acid of phosphomolybdic acid and phosphotungstic acid. Among these, preferably used is a lake pigment prepared by use of the complex acid of phosphomolybdic acid and phosphotungstic acid.

Herein, the above-described lake pigment prepared by use of the complex acid of phosphotungstic acid and molybdic acid is also referred to as a PTMA lake.

Specific examples of the compound represented by General Formula (1) are given below, however, the present invention is not limited thereto.

$R_{1a}R_{1b}R_{2a}R_{2b}R_3R_4R_5X^-$ Compound of General Formula (1)

$C_2H_5HC_2H_5H3\text{-}CH_33'\text{-}CH_32\text{-}CO_2CH_3Cl^-$ Compound 1 (PTMA lake)

$C_2H_5HC_2H_5H3\text{-}CH_33'\text{-}CH_32\text{-}CO_2CH_3Cl^-$ Compound 2 (PTMA lake)

$C_2H_5HC_2H_5HHH2\text{-}COOHCl^-$ Compound 3

The compound represented by General Formula (1) can be synthesized in the same manner as in a conventionally known xanthene series rhodamine compound such as C. I. solvent-red 49, C. I. solvent-red 52 and C. I. solvent-red 180, or is available in the market.

The compound represented by the General Formula (1) can be brought into the lake before use. Herein, the lake formation can be carried out by a publicly known method, for example, the compound represented by General Formula (1) is dissolved in an aqueous acetic acid solution and thereto, an aqueous disodium phosphate solution, an aqueous sodium tungstate solution or an aqueous sodium molybdate solution is added to precipitate a pigment formed into a lake. The lake pigment is filtered, washed and then dried, followed by pulverization before use.

The content of the compound represented by General Formula (1) in the colorant is preferably 30% by mass or more, is more preferably from 30% by mass to 100% by mass, and is particularly preferably from 40% by mass to 80% by mass.

Further, the following colorants can be used. The electrostatic image developing toner (hereinafter also referred to simply as a toner) of the present invention is preferably prepared by salting out/fusing the binder resin particles and the colorant particles. Listed as colorants (the colorant particles subjected to salting out/fusing with the resin particles) which construct the toner of the present invention may be various inorganic pigments, organic pigments, and dyes. Employed as the inorganic pigments may be those conventionally known in the art. Specific inorganic pigments are listed below.

Employed as black pigments are, for example, carbon black such as furnace black, channel black, acetylene black, thermal black, lamp black, etc., and in addition, magnetic powders such as magnetite, ferrite, etc.

If desired, these inorganic pigments may be employed individually or in combination of a plurality of these. Further, the added amount of the pigments is commonly from 2 to 20% by mass, and is preferably from 3 to 15% by mass, with respect to the polymer.

When employed as a magnetic toner, the above-described magnetite can be added. In that case, from the viewpoint of providing specified magnetic properties, the magnetite is incorporated into the toner preferably in an amount of 20 to 60% by mass.

Further, the colorant as described below can be simultaneously used. Employed as the organic pigments and dyes may be those conventionally known in the art. Specific organic pigments as well as dyes are exemplified below.

Examples of the pigments for magenta or red include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, 48:2, 48:3, 48:4, 48:5, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178 and C.I. Pigment Red 222.

Examples of the pigments for orange or yellow include C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment yellow 180, C.I. Pigment Yellow 185, C.I. Pigment Yellow 155 and C.I. Pigment Yellow 156.

Examples of the pigments for green or cyan include C.I. Pigment Blue 15, C.I. Pigment Blue 15:2, C.I. Pigment Blue 15:3, C.I. Pigment Blue 16, C.I. Pigment Blue 60 and C.I. Pigment Green 7.

Employed as dyes may be C.I. Solvent Red 1, 49, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; etc. Further these may be employed in combination.

If desired, these organic pigments, as well as dyes, may be employed individually or in combination of plural selected ones. Further, the added amount of pigments is commonly from 2 to 20% by mass, and is preferably from 3 to 15% by mass, with respect to the polymer.

The colorants (colorant particles) constructing the toner of the present invention may also be employed while subjected to surface modification. Employed as the surface modifier may be those conventionally known in the art, and specifically, preferably employed may be silane coupling agents, titanium coupling agents, aluminum coupling agents, etc. Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, Y-chloropropyltrimethoxysilane, vinyltrichlorosilane, vinyltrimethoxysilane, vinyltriethoxysilane, Y-methacryloxypropyltrimethoxysilane, Y-glycidoxypropyltrimethoxysilane, Y-mercaptopropyltrimethoxysilane, Y-aminopropyltriethoxysilane, and Y-ureidopropyltriethoxysilane. Examples of the titanium coupling agent include those marketed with brand "Plainact" TTS, 9S, 38S, 41B, 46B, 55, 138S, 238S etc., produced by Ajinomoto Corporation, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed those produced by Nihon Soda Co., Ltd. Examples of the aluminum coupling agent include "Plainact AL-M" produced by Ajinomoto Corporation.

These surface modifiers are added preferably in amount of 0.01 to 20% by mass, and more preferably 0.1 to 5% by mass with respect to the colorants. Surface of the colorant particle may be modified in such a way that the surface modifier is added in the dispersion liquid of colorant particle, then the dispersion liquid is heated to conduct a reaction. As described above, the colorant particle having subjected to the surface modification is separated by filtration and dried after repeating rinsing and filtering with the same solvent.

The toner particle preferably has a domain-matrix structure. The domain-matrix structure used herein refers to a structure where an isolated phase exists in the form of domain in the continuous phase. Specifically, in the electrostatic image developing toner of the present invention, it is preferable that respective components of the binder resin and the colorant constructing the toner particle are not dissolved with together and independently form individual phase. Therefore, the toner particle having the domain-matrix structure is preferably used.

It is preferable that the toner particle takes a structure where the domain of the colorant exists in the continuous phase (matrix) of the resin.

It can be confirmed by the cross section photograph taken by an transmission electron microscope that the toner particle has the domain-matrix structure since the region of the matrix and the region of the domain each is shown by the region different in the luminance in the toner particle. That is, it is confirmed by the transmission electron microscope that particulate-shaped domains (being the phase of the colorant) each different in the luminance exist in the continuous phase (being the phase of the binder resin). In addition, from the observation results of the transmission electron microscope, a factor specifying the domain-matrix structure in the toner particle, such as the number of the domains in one toner particle and shape coefficient of the domain can be obtained as values.

The luminance of the transmission electron microscope is formed by visualizing the difference of the electron transmittance caused by the difference of each component constructing the toner particle, namely, the binder resin and the colorant. The colorant is generally taken as a low luminance image since the electron transmittance of the colorant is lower than that of the binder resin.

In the electron-microscopic photograph, the pixel classified into a grade within the range of from 0 to 99 is defined as the low luminance and the pixel classified into a grade within the range of from 80 to 160 is defined as the medium luminance and the pixel classified into a grade within the range of from 127 to 255 is defined as the high luminance when the luminance signal of the pixel is classified in 256 grades. However, in the present invention, the grade may be a relative value by which the components of the toner particle can be each distinguished on the photograph, and it is not necessarily an essential requirement that the luminance of the colorant falls within the low luminance defined by the above-described range.

As described above, the matrix and the domain can be visually judged and distinguished on the electron-microscopic photograph by distinguishing the each component in the toner particle based on the luminance of the individual component. The distinguishing is performed by converting the luminance information to the image information capable of being visually distinguished by an image analyzing apparatus attached to the electron microscope apparatus.

Figure 2A:
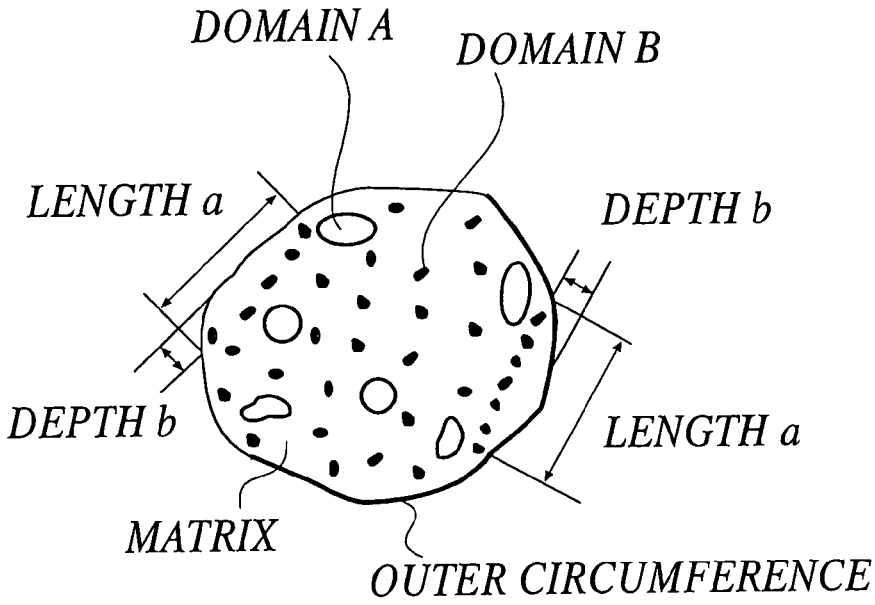
FIGS. 2A and 2B are schematic views explaining the toner particle having a domain-matrix structure.
Figure 2B:
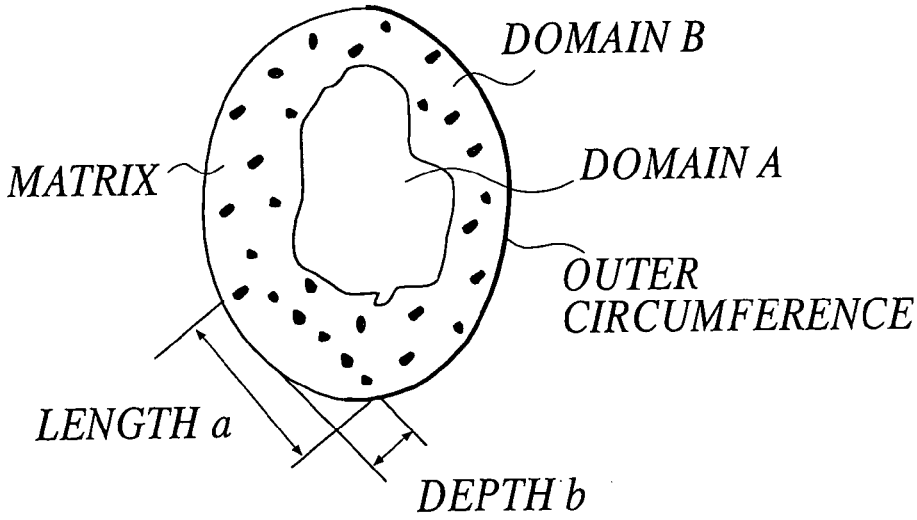

FIGS. 2A and 2B are each a schematic view showing one example of toner particle having the domain-matrix structure. It is observed on the electron-microscopic photograph that the toner particle having the domain-matrix structure is constructed by the continuous phase and the domain as shown in the schematic view.

Moreover, it is observed that a portion with a length of a and a depth of b containing no domain exists along the circumference of the toner particle.

In FIGS. 2A and 2B, it is observed that as the domain in the toner particle, the binder resin as a component of the toner also forms a domain structure in the continuous phase in addition to the domain of the colorant.

The structure of the toner particle is sufficiently observed by using a transmission electron microscope apparatus commonly known among those skilled in the art, such as a transmission electron microscope "LEM-2000 (manufactured by Topcon Co., Ltd.)". In the present invention, the number of the domain in the toner particles having the domain-matrix structure is calculated from the results of a transmission electron microscope photograph, determined based on the projection plane of 1,000 or more toner particles photographed with a magnitude of 10,000 times.

The photographing by the transmission electron microscope is performed in the commonly known manner for measuring the toner particle. More specifically, the cross-section of the toner particle may be concretely measured in the following manner:

The toner particle is sufficiently dispersed in epoxy resin hardenable at an ordinary temperature and embedded in the resin by hardening, or the toner is dispersed in a fine powder of styrene resin having a particle size of about 100 nm and pressed to form a block, and the block obtained is dyed by triruthenium tetraoxide or triosmium tetraoxide or a combination thereof, according to necessity, and the block is sliced by a microtome having a diamond cutting edge to prepare a thin sliced sample. The sliced sample thus prepared is photographed by the transmission electron microscope (TEM) to take a photograph of the cross-section of the toner particle. From the obtained picture, the shape of the area of the colorant in the toner particle is visually confirmed and the properties of the domain in the toner particle is obtained by processing the image information of the taken photograph by the use of an image processing apparatus "Lusex F" (manufactured by Nicole Co., Ltd.), attached to the electron microscope apparatus.

Employing the above-described method, the structure of the toner particle is specified. Factors specifying the structure of the toner particle are described in detail below.

The domain of the component of the colorant existing in the toner particle is shown as a domain B in the schematic views of FIGS. 2A and 2B. As is cleared by the schematic view, a domain of the colorant component as well as a domain of the other toner component may exist in the toner particle having the domain-matrix structure. The domain of the colorant component and the domain of the other component can be easily distinguished on the electron-microscopic photograph since both domains are different in luminance. The domain of the colorant component in the toner particle is specified based on the area of Voronoi polygon as described below.

Values for specifying the domain in the domain-matrix structure in the toner particle is calculated based on the image information observed by an electron microscope apparatus while employing the image analysis device installed in the electron microscope apparatus.

Figure 3:
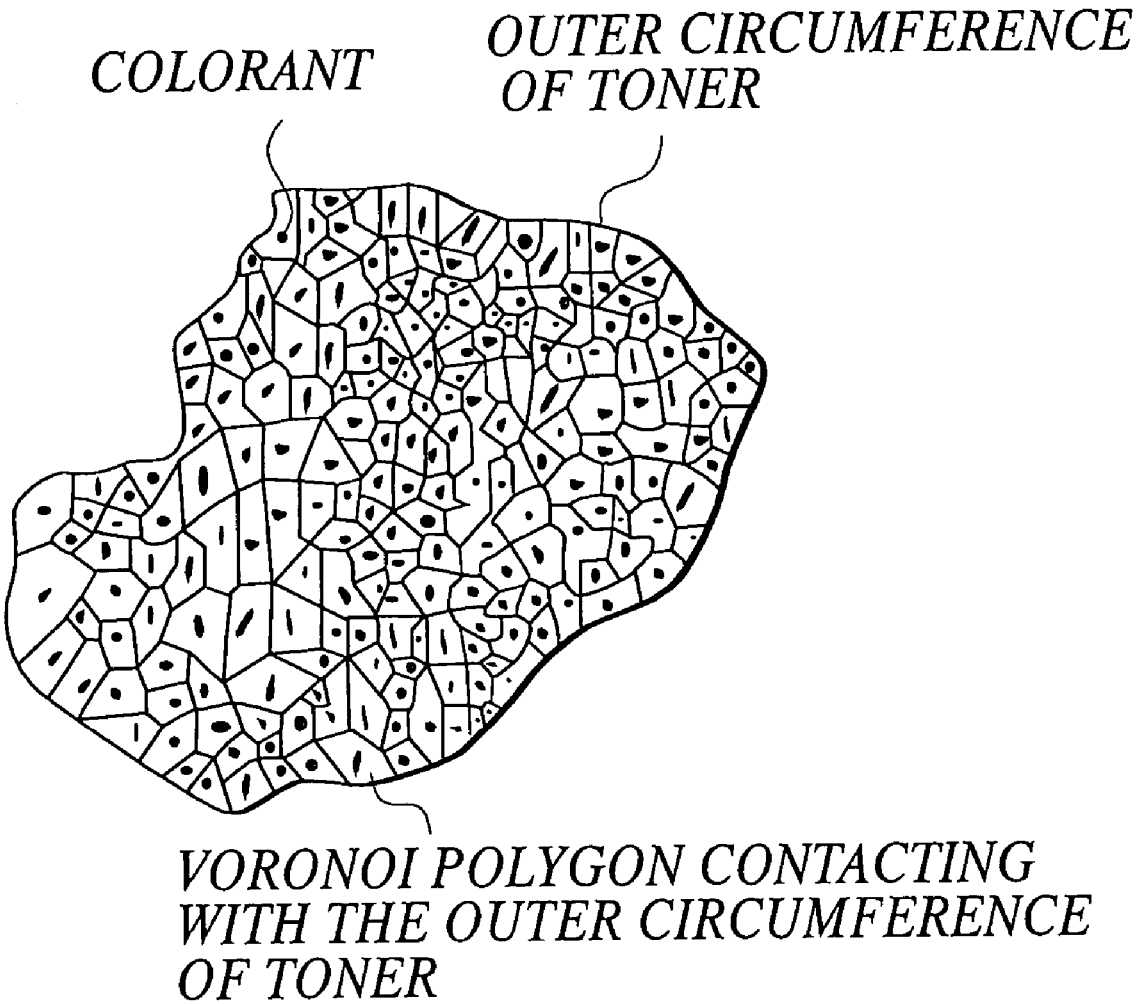
FIG. 3 is a schematic view showing a state where the toner particle having a domain-matrix structure is divided by Voronoi polygons.

The area of the Voronoi polygon employed in the present invention, as described herein, refers to the domain portion occupying state in the toner particle. The Voronoi polygon or Voronoi polyhedron, as described herein, is as follows. As described in, for example, "Iwanami Rikagaku Jiten (Iwanami Physical and Chemical Dictionary)", when many points are scattered in a space or on a plane, the whole space or the whole plane is divided into polyhedrons or polygons by creating a perpendicular bisecting plane or a perpendicular bisecting line of the adjacent points. The polyhedron formed as above is called Voronoi polyhedron, while the polygon formed as above is called Voronoi polygon. Such division of the space as well as the plane is called Voronoi division. FIG. 3 shows one example of the toner particle according to the present invention which is divided by Voronoi polygons.

As described above, as the scale showing the domain portion occupying ratio in the toner particle, the domain portion occupying state in the domain-matrix structure of the toner particle is shown employing the area of the Voronoi polygon obtained by the Voronoi division. Namely, the center of gravity of the domain existing in the toner particle is focused on, and a polygon is formed employing a perpendicular bisecting line between the centers of gravity of adjacent domains. These polygon areas are calculated based on photographs obtained employing the transmission electron microscope while employing the image analysis device installed in the transmission electron microscope apparatus.

A large Voronoi polygon area indicates that the distance between the centers of gravity of adjacent domains is large. Namely, it indicates that the domain portion occupying state in the particle is not dense. On the other hand, a small Voronoi polygon area indicates that the distance between the centers of gravity of adjacent domains is short. Namely, it indicates that the domain occupying state in the particle is in a dense state. In the present invention, the Voronoi polygon area of the domain portion in the toner particle is determined in such a manner that Voronoi polygons of 1,000 toner particles are measured and the average per one toner particle is calculated.

Incidentally, the Voronoi polygon is generally and mathematically defined employing the formula described below.

<<Area of Voronoi Polygon>>

The set of Voronoi polygon V(i) regarding N independent points P(i) ($1 \leqq i \leqq N$) in two-dimensional space R2 or three-dimensional space R3 is:

$$V(i)=\{X \mid |X-P(i)|<|X-P(j)| \text{ for all } i \text{ and } j\}$$

wherein X and P each represents the position vector and | | represents the distance in Euclidean space.

V(i) as defined above assumes that in R2, a Voronoi polygon is formed, and in R3, a Voronoi polyhedron is formed. When V(i) is directly adjacent to V(j), it is defined that the boundary between Voronoi polygons becomes one part of the perpendicular bisecting line in a line connecting a point P(i) with a point P(j). The Euclidean space equals one which is defined and described in "Suurikagaku Daijiten (Mathematical Science Encyclopedia)".

Further, the center of gravity of the toner particle of the present invention, as well as the center of gravity of each domain in the toner particle is obtained employing the moment of images, which is automatically calculated by the image analysis device installed in the transmission electron microscope apparatus. Herein, the coordinates of the center of gravity of the toner particle are obtained as follows. The product of the luminance value of a minute area at an optional point of the toner particle, and the coordinate values of the optional point is obtained. Further, regarding all the coordinates existing in all the toner particles, the product of the luminance value and the coordinate values is obtained. Then, the coordinates of the center of gravity are obtained by dividing the sum of the resulting products by the luminance value of the toner particle (the sum of the luminance value at each coordinate point obtained as above). Further, the center of gravity of the domain is obtained in the same manner as in the above by obtaining the luminance value at an optional coordinate point in the domain. As noted, the coordinates of the center of gravity of the toner particle, as well as the coordinates of the center of gravity of each domain existing in the toner particle are calculated based on the luminance value at each of the optional points. Namely, the coordinates are calculated based on the brightness and darkness of images.

In the present invention, preferably used is a toner that the average area of the Voronoi polygon formed by the perpendicular bisecting line between the centers of gravity of adjacent domains in the toner particle, is from 20,000 $nm^2$ to 120,000 $nm^2$ and the variation coefficient of the average of the area is 25% or less. The variation coefficient of the area of the Voronoi polygon is calculated based on the formula below:

(Calculation of variation coefficient of the area of the Voronoi polygon) variation coefficient of the area of the Voronoi polygon=(S1/K1)×100 (%)

wherein S1 represents the standard deviation in the area of the Voronoi polygon of the domain portion existing in the toner particle, and K1 represents the average area of the Voronoi polygon.

Further, it is preferable that the average area of the Voronoi polygon of the adjacent domains in the toner particle is from 40,000 $nm^2$ to 100,000 $nm^2$ and the variation coefficient of the average area is 20% or less.

In the present invention, preferably used is a toner particle that the average area of the Voronoi polygon of the adjacent domains in the toner particle is from 20,000 $nm^2$ to 120,000 $nm^2$ and a ratio of the domain forming the Voronoi polygon having an area of 160,000 $nm^2$ or more is 3% by number to 20% by number in all the domains. Further, from the viewpoint of making the charge amount distribution uniform, the ratio of the domain forming the Voronoi polygon having an area of 50,000 $nm^2$ or less is preferably 30% by number or more and more preferably 60% by number or more in all the domains existing in one toner particle.

The variation coefficient of the average area of the Voronoi polygon formed by adjacent domains in the toner particle specifies the fluctuation of the area of the Voronoi polygon, namely it specifies the fluctuation of the domain portion occupying state in the toner particle. The variation coefficient of the average area of the Voronoi polygon is preferably 25% or less, and is more preferably 20% or less. Incidentally, it is not required that the variation coefficient is 0 percent, namely, the state in which the average area of the Voronoi polygon results in no fluctuation, in other wards, the domain portion occupying state in the toner particle results in no fluctuation, that is, any toner particle is in the same domain occupying state.

Still further, in the present invention, it is preferable that the ratio of the domain forming the Voronoi polygon having an area of 160,000 $nm^2$ or more is 3% by number to 20% by number in all the domains existing in one toner particle. This means that those domains are suitably scattered in the toner particle. That is, it is preferable that each domain maintains the suitable distance as described above, whereby the domains are not locally positioned in the toner particle and colorants are effectively incorporated into the toner particle.

Further, it is preferable that the area of the Voronoi polygon formed by the domain, which is located within the specified range from the center of gravity of the toner particle, is smaller than that of the Voronoi polygon which is formed by the domain beyond the range. Namely, it is preferable that the average area of the Voronoi polygon formed by the domain, which is located beyond the radius 1,000 nm circle having its center at the center of gravity of the toner particle, is greater than that of the Voronoi polygon formed by the domain which is located in the 1,000 nm radius circle. This means that in the toner particle, domains are preferably scattered sparsely in the area somewhat further from the center of gravity of the toner particle. By satisfying the conditions as described above, in the electrostatic image developing toner of the present invention, the domains are suitably scattered in the toner particle so that the effects described in the present invention can be preferably obtained.

Further, in the toner particle having the domain-matrix structure, the toner particle preferably has regions, in which no domains are located in the region along the outer circumference of the toner particle. The region in which no domains are located as used herein means the region shown by the length of "a" and the depth of "b" along the outer circumference of the cross-section of the toner particle in the schematic views of FIGS. 2A and 2B.

Namely, it is preferable that the toner particle preferably has regions, in which no domains are located along the outer circumference of the cross section of the toner particle. The region has a depth of 100 nm to 200 nm, more preferably 120 nm to 180 nm and a length of 500 nm to 6,000 nm, more preferably 800 nm to 4,000 nm.

As described above, it is assumed that the absence of domains in the specified regions along the outer circumference of the toner particle contributes to enhancing electric charge holding characteristics and preventing scattering of light from occurring in the vicinity of the toner surface. Further, it is also assumed that when the colorant added in the toner particle is suitably dispersed in particles, the effect described in the present invention is accelerated.

Further, the matrix portion of the toner particle having the domain-matrix structure of the present invention contains the binder resin as a component.

Further, a domain of the colorant component as well as a domain of the other toner constituent element may exist in the toner particle having the domain-matrix structure. The domain of the other toner constituent element includes a domain of a crystalline material. The crystalline material is concretely an organic compound having a melting point, and preferably a carbon hydride compound containing an ester group in the chemical structure thereof. The melting point of the crystalline material in the toner particle is lower than the softening point of the toner, concretely 130° C. or less. It is preferable that the organic compound has an ester group in the structure thereof. Examples thereof include a crystalline polyester compound.

It can be confirmed by DSC (a differential scanning calorimetry) that the crystalline material constructing the domain portion has the melting point. Moreover, it can be confirmed by a means such as an X-ray diffraction apparatus that the material is crystallizable. The crystalline material contained in the toner includes one capable of functioning as the mold-releasing agent at the formation of the image.

From the viewpoint of improving the adhesiveness of the toner to paper by lowering the melt viscosity of the toner, and realizing a suitable anti-offset by holding the elastic modulus in the high-temperature range within a preferable level even when the crystalline material exists, the melting point of the crystalline material is preferably from 50° C. to 130° C., more preferably from 60° C. to 120° C.

The melting point of the crystalline material is a value measured by a differential scanning calorimetry (DSC). In concrete, the temperature is defined as the melting point, at which the maximum endothermic peak measured by raising the temperature of the material from 0° C. to 200° C. at a rate of 10° C./min (the first temperature raising process) is observed. The melting point is equal to the latter-mentioned "the endothermic peak (P1) in the first temperature raising process by DSC".

Specific example of the apparatus for measuring the melting point includes DSC-7 manufactured by Parkin-Elmer Co., Ltd. The specific measuring procedure of the melting point by DSC is as follows: The sample to be measured is stood at 0° C. for 1 minute and then heated up to 200° C. at the rate of 10° C./min. The temperature at which the maximum endothermic peak is observed in the course of the foregoing process is defined as the endothermic peak P1 in the first temperature raising process. Then the sample is stood at 200° C. for 1 minute and then cooled at the rate of 10° C./min. The temperature at which the maximum exothermic peak is observed in the course of the foregoing cooling process is defined as the exothermic peak P2 in the first cooling process.

The crystalline material having an endothermic peak (P1) in the first temperature raising process by DSC of from 50° C. to 130° C., particularly from 60° C. to 120° C. is preferable. Moreover, it is preferable that the exothermic peak P2 in the first cooling process by DSC is from 30° C. to 110° C., particularly from 40° C. to 120° C. Here, the endothermic peak (P1) and the exothermic peak (P2) have a relation of P1≧P2. The difference of the temperature (P1−P2) is preferably 50° C. or less even though there is no specific limitation.

An excellent offset preventing effect (a wide fixing temperature range) and an excellent fixing ability (a high fixing ratio) can be exerted by incorporating the crystalline material having the foregoing thermal property. It is preferable for exerting the effect of the present invention that the binder resin and the crystalline material exist in a state of the separated phase from each other.

That is, the crystalline material which is sharply melted causes the lowering of the melt-viscosity of the whole toner and the fixing ability of the toner can be improved. The anti-offset is not degraded since lowering in the elastic modulus in the high-temperature range can be inhibited by the state in which the crystalline material and the binder resin are in the separated phase from each other.

A shape of the toner particle according to the present invention is detailed. As for the toner particle according to the present invention, by employing a toner constructed from the toner particle having a variation coefficient of the toner shape coefficient of 16% or less, as well as having a number variation coefficient in the number particle size distribution of 27% or less, exterior additives on the toner surface uniformly exists and thereby, providing a narrow charge amount distribution and high fluidity. As a result, excellent developing properties and fine line reproduction can be obtained and stable cleaning properties can be formed over an extended time of period.

Further, the present inventors have made studies by taking notice of a minute shape of each toner particle. As a result, it has been found that a corner part of the toner particle becomes round in the developing apparatus and the rounded part accelerates the exterior additives embedded in the toner particle, whereby charge amount varies, and fluidity and cleaning properties are reduced.

Further, it is presumed that when an electric charge is given to the toner particle by use of frictional electrification, the exterior additives are easily embedded, particularly, in the corner part, and electric charging of the toner particle easily becomes uneven. Specifically, also by employing a toner constructed from a toner particle in which the ratio of toner particles having no corners is set at 50% by number or more and the number variation coefficient in the number particle size distribution is adjusted to 27% or less, it is possible to form an image having high image quality over an extended time of period, which exhibits excellent developing property, as well as excellent fine line reproduction.

Further, it has been found that also in the case of using the toner in which the shape thereof is uniformed as a specific shape, embedding of the exterior additives does not occur and the charge amount distribution becomes narrow. That is, also in the case of using the toner in which the ratio of toner particles having a shape coefficient of 1.01 to 1.6 is 65% by number or more and a variation coefficient of the shape coefficient is 16% or less, it is possible to form an image having high image quality over an extended time of period, which exhibits excellent developing property, as well as excellent fine line reproduction.

The number particle size distribution and the number variation coefficient of the toner are described. The number particle size distribution and the number variation coefficient of the toner are measured employing a Coulter Counter TA-11 or a Coulter Multisizer (manufactured by Coulter Co.)

In the present invention, employed was the Coulter Multisizer which was connected to an interface which outputs the particle size distribution (manufactured by Nikkaki), as well as to a personal computer.

An aperture having a size of 100 μm is used in the Coulter Multisizer. The volume and the number of particles having a size of at least 2 μm are measured and the particle size distribution as well as the average particle size is calculated. The number particle size distribution as described herein means the relative frequency of toner particles with respect to the particle size, and the number average particle size as described herein means the median diameter of 50% in the number particle size distribution, that is, $D_n$ 50.

The number variation coefficient in the number particle size distribution of toner is calculated by the formula described below:

Number variation coefficient=$[S/D_n]\times 100$ (%)

wherein S represents the standard deviation in the number particle size distribution, and Dn represents the number average particle size (μm).

From the viewpoint of decreasing voids in the transferred toner layer to improve fixing property as well as to minimize offset, and making the charge amount distribution narrow to enhance the transfer efficiency as well as to attain higher image quality, the number variation coefficient is preferably 27% or less, and is more preferably 25% or less.

Methods to control the number variation coefficient are not particularly limited. For example, a method may be employed in which toner particles are classified employing force of wind. However, in order to decrease the number variation coefficient, classification in liquid is more effective. This classifying method in liquid include one in which a toner is prepared by classifying and collecting toner particles in response to the difference in sedimentation rate generated by the difference in toner particle size while controlling rotational frequency, employing a centrifuge.

The shape coefficient of the toner particles is described. Preferably used toner is one in which the ratio of toner particles having a shape coefficient of 1.01 to 1.6 is 65% by number or more in all the toner particles and the variation coefficient of the shape coefficient is 16% or less, and the number variation coefficient in the number particle size distribution is 27% or less.

The shape coefficient of the toner is expressed by the following formula and represents the roundness of toner particles.

$$\text{Shape coefficient}=[(\text{maximum diameter}/2)^2\times\pi]/\text{projection area}$$

Wherein the maximum diameter means the width of a particle, which is the distance between two parallel lines when a projection image of a toner particle on a plane is placed between the two parallel lines and the distance between the two parallel lines becomes maximum, while the projection area means the area of the projection image of the particle on a plane. In the present invention, the shape coefficient is determined in such a manner that toner particles are photographed under a magnification factor of 2,000, employing a scanning type electron microscope, and the resultant photographs are analyzed employing "Scanning Image Analyzer", manufactured by Nippon Denshi Co. At that time, 100 toner particles are employed and the shape coefficient is obtained employing the above-described calculation formula.

Figure 4A:
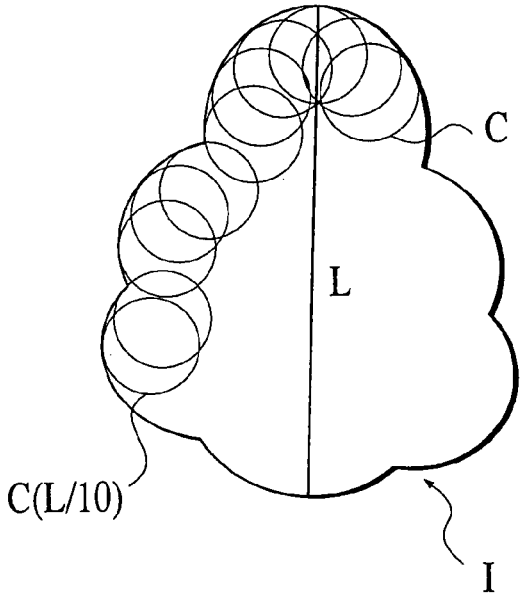
FIGS. 4A, 4B and 4C are schematic views explaining a toner particle having no corners and a toner particle having corners.

Next, the toner particles having no corners are described. The toner particles having no corners as described herein mean those substantially having no projection to which charges are concentrated or which tends to be worn down by stress. Namely, as shown in FIG. 4A, the main axis of toner particle T is designated as L. Circle C having a radius of L/10, which is positioned in toner particle T, is rolled along the periphery of toner particle T, while remaining in contact with the circumference at one point. When it is possible to roll any part of the circle C without substantially crossing over the circumference of toner particle T, a toner is designated as "a toner having no corners". "Without substantially crossing over the circumference" as described herein means that there is at most one projection at which any part of the rolled circle crosses over the circumference.

Figure 4B:
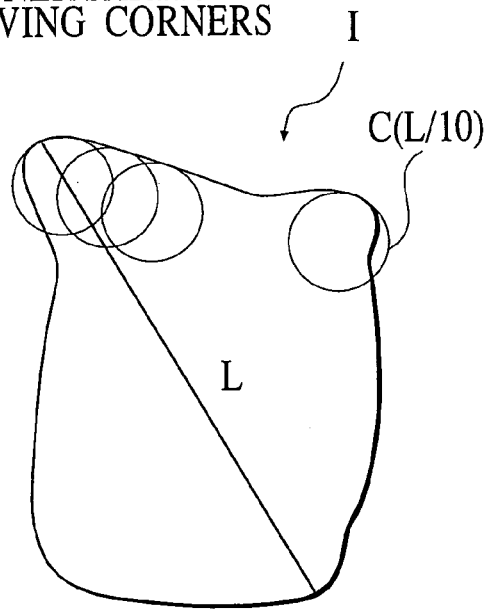
Figure 4C:
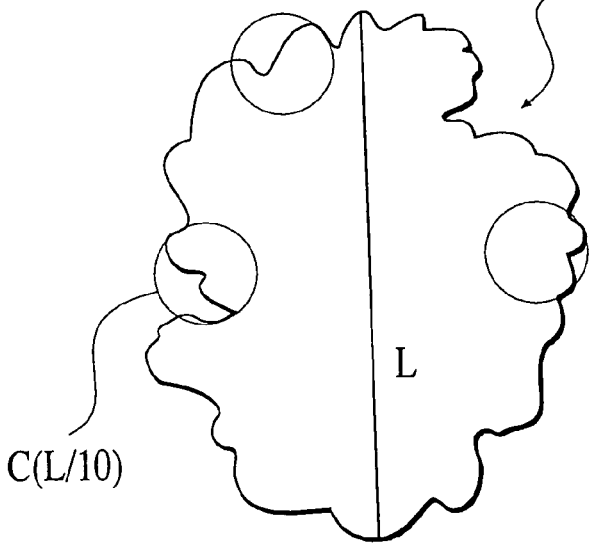

Further, the "main axis of a toner particle" as described herein means the width of a particle, which is the distance between two parallel lines when a projection image of the toner particle on a plane is placed between the two parallel lines and the distance between the two parallel lines becomes the maximum. Incidentally, FIGS. 4B and 4C each is a schematic view showing the projection images of a toner particle having corners.

Toner having no corners is measured as follows. First, an image of a magnified toner particle is made employing a scanning type electron microscope. The resultant picture of the toner particle is further magnified to obtain a photographic image at a magnification factor of 15,000. Subsequently, employing the resultant photographic image, the presence and absence of the corners is determined. The measurement is carried out for 1000 toner particles.

From the viewpoint of reducing formation of fine toner particles due to stress with a developer conveying member and the like to minimize staining onto the surface of the developer conveying member, as well as to narrow the charge amount distribution to stabilize charging property, resulting in more excellent image quality over an extended period of time, the ratio of toner particles having no corners in all the toner particles is preferably 50% by number or more, and is more preferably 70% by number or more.

Methods to obtain toners having no corners are not particularly limited. For example, as previously described as the method to control the shape coefficient, it is possible to obtain toners having no corners by employing a method in which toner particles are sprayed into a heated air current, a method in which toner particles are subjected to application of repeated mechanical force, employing impact force in a gas phase, or a method in which a toner is added to a solvent which does not dissolve the toner and which is then subjected to application of revolving current.

The toner, which is preferably employed, is as follows. The particle size of toner particles is designated as D (μm). In a histogram showing a number based particle size distribution, in which natural logarithm lnD is taken as the abscissa and the abscissa is divided into a plurality of classes at an interval of 0.23, preferred is a toner which exhibits 70% or more of the sum (M) of the relative frequency (m1) of toner particles included in the highest frequency class, and the relative frequency (m2) of toner particles included in the second highest frequency class.

By adjusting the sum (M) of the relative frequency (m1) and the relative frequency (m2) to 70% or more, the dispersion of the resultant toner particle size distribution narrows. Thus, by employing the toner in an image forming process, it is possible to securely minimize the generation of selective development.

In the present invention, the histogram, which shows the number based particle size distribution, is one in which natural logarithm lnD (wherein D represents the size of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). The histogram is drawn by a particle size distribution analyzing program in a computer through transferring to the computer via the I/O unit particle size data of a sample which are measured employing a Coulter Multisizer under the conditions described below.

[Measurement Conditions]

1: Aperture: 100 μm

2: Sample preparation method: an appropriate amount of a surfactant (a neutral detergent) is added while stirring in 50 ml to 100 ml of an electrolyte, ISOTON 11 (manufactured by Coulter Scientific Japan Co.) and 10 mg to 20 mg of a sample to be measured is added to the resultant mixture. Preparation is then carried out by dispersing the resultant mixture for one minute employing an ultrasonic homogenizer.

The particle size of the toner particle is described. The particle size of the toner particle is preferably prepared to 3 μm to 9 μm, more preferably 4.5 μm to 8.5 μm and particularly preferably 5 μm to 8 μm in terms of the number average particle size.

The particle size of the toner particle can be controlled utilizing the concentration of coagulants (salting agents), the added amount of organic solvents, the fusion time, or the composition of the polymer in the toner production method.

By employing the toner having the number average particle size of 3 μm to 9 μm, the transfer efficiency is improved, half-tone image quality, and fine line or dot image quality is improved. It is possible to calculate or measure the particle size distribution or the number average particle size of toner particles, employing a Coulter Counter TA-II, a Coulter Multisizer (both manufactured by Coulter Co.), SLAD 1100 (a laser diffraction type particle size measuring apparatus, produced by Shimadzu Seisakusho), etc. In the present invention, measurement and calculation are performed employing the Coulter Multisizer which is connected to an interface which outputs the particle size distribution (manufactured by Nikkaki), as well as to a personal computer.

The production method of the toner of the present invention is described below. The toner can be obtained by polymerizing at least a polymerizable monomer in an aqueous medium. In the production method, the polymerizable monomer is polymerized by a suspension polymerization method to prepare resin particles, or the monomer is subjected to emulsion polymerization or mini-emulsion polymerization in a solution (an aqueous medium) to which an emulsified composition of necessary additives is added, to prepare fine resin particles, if necessary, charge controlling resin particles are added and then organic solvents, coagulants such as salts, etc. are added to allow the resin particles to aggregate and fuse each other.

<Suspension Polymerization>

One example of the method for producing the toner of the present invention is as follows. Charge controlling resins are dissolved into polymerizable monomers and thereinto, various construction materials such as colorants, and if desired, releasing agents, further polymerization initiators, etc. are incorporated, and each of the construction materials is dissolved or dispersed into the polymerizable monomers employing a homogenizer, a sand mill, a sand grinder, an ultrasonic homogenizer, etc. The polymerizable monomers having dissolved or dispersed thereinto these various construction materials are dispersed into an aqueous medium containing a dispersion stabilizer so as to form oil droplets having a desired size as a toner by a homo-mixer or a homogenizer. Thereafter, the resulting dispersion liquid is transferred to a reaction apparatus (a stirring apparatus) having a stirring mechanism composed of stirring blades described below, and the polymerization reaction is progressed by heating. After completing the reaction, the dispersion stabilizer is removed from the polymer particles and the polymer particles are filtered, washed, and further dried to prepare the toner of the present invention. The "aqueous medium" as used herein means one in which at least 50% by mass of water is incorporated.

<Emulsion Polymerization>

Further, listed as another method for producing the toner of the present invention may be one in which resin particles are salted-out/fused in an aqueous medium to prepare the toner. The method is not particularly limited but it is possible to list, for example, methods described in Japanese Patent Application Publication-Tokukaihei-5-265252, Japanese Patent Application Publication-Tokukaihei-6-329947 and Japanese Patent Application Publication-Tokukaihei-9-15904. Namely, it is possible to form the toner of the present invention by employing a method in which at least two of the dispersion particles of components such as resin particles, colorants, etc., or fine particles, composed of resins, colorants, etc., are salted-out, aggregated or fused, specifically in such a manner that after dispersing these in water employing emulsifying agents, the resultant dispersion is salted out by adding coagulants having a concentration of at least the critical coagulation concentration, and simultaneously the formed polymer itself is heat-fused at a temperature higher than the glass transition temperature, and then while forming the fused particles, the particle size is allowed gradually to grow; when the particle size reaches the desired value, particle growth is stopped by adding a large amount of water; the resultant particle surface is made smooth while being further heated and stirred, to control the shape and the resultant particles which incorporate water, are again heated and dried in a fluid state. Further, herein, solvents such as alcohols which are infinitely soluble in water may be simultaneously added together with the coagulants.

In the method for producing the toner, preferably used is a method of salting-out/fusing composite resin fine particles and colorant particles, in which the composite resin fine particles are formed by passing through a process of dissolving a crystalline material in a polymerizable monomer and then polymerizing the polymerizable monomer. When dissolving the crystalline material in the polymerizable monomer, the crystalline material may be dissolved or fused.

The toner is also preferably produced by a process of salting-out/fusing composite resin fine particles and colorant particles, in which the composite resin fine particles are formed by the multi-step polymerization method. Herein, the multi-step polymerizing method is described below.

(Production Method of Composite Resin Particles Formed by Multi-step Polymerization Method)

When employing the multi-step polymerization method, the production method of the toner preferably comprises the following processes:

1. A multi-step polymerization process
2. A salting-out/fusion process to produce toner particles by salting-out/fusing composite resin particles and colorant particles
3. Filtering and washing processes to filter the toner particles from the toner particle dispersion system and to remove a surfactant, etc. from the toner particles
4. A drying process to dry the washed toner particles, and
5. A process to add an exterior additive to the dried toner particles.

Each of the processes is described in detail below.

[Multi-step Polymerization Process]

The multi-step polymerization process is a polymerization process for preparing the composite resin particle having broader molecular weight distribution so as to obtain a toner enhanced in anti-offset characteristics. Specifically, a plural of polymerization reactions are conducted in separate steps to form phases each having different molecular weight distribution in one resin particle. The process is intentionally conducted such that the obtained resin particle has a gradient of molecular weight from the center to the surface layer of the particle. For example, a method is employed, in which a dispersion liquid of higher molecular weight resin particles is firstly obtained and then, a polymerizable monomer and a chain transfer agent are newly added to form a lower molecular weight surface layer.

In the present invention, it is preferred from the viewpoint of the production stability and the anti-crush strength of the obtained toner to apply the multi-step polymerization method including three or more polymerization steps. The two- and tree-step polymerization methods, which are representative examples of the multi-step polymerization method, are described below. In the toner obtained by such a multi-step polymerization reaction, preferred is one in which the closer to the surface the molecular weight is lower in view of the anti-crush strength.

<Two-step Polymerization Method>

The two-step polymerization method is a method for producing the composite resin particle composed of the central portion (core) comprising the high molecular weight resin containing the crystalline material and an outer layer (shell) comprising the low molecular weight resin.

The method is described in detail. First, a monomer solution is prepared by dissolving the crystalline material in a monomer, the monomer solution is dispersed in an aqueous medium (e.g., an aqueous solution of a surfactant) in a form of oil drop, and the system is subjected to a polymerization treatment (the first polymerization step) to prepare a dispersion liquid of higher molecular weight resin particles each containing the crystalline material.

Next, a polymerization initiator and a monomer to form the lower molecular weight resin are added to the prepared resin particle dispersion liquid, and the monomer is subjected to a polymerization treatment (the second polymerization step) in the presence of the resin particle to form a covering layer composed of the lower molecular weight resin (a polymer of the monomer) onto the surface of the resin particle.

<Three-step Polymerization Method>

The three-step polymerization method is a method for producing the composite resin particle composed of the central portion (core) comprising the higher molecular weight resin, the inter layer containing the crystalline material and the outer layer (shell) comprising the lower molecular weight resin. In the toner, the particles exist as the composite resin particles as described above.

This method is described in detail. Firstly, a dispersion liquid of the resin particles prepared by the polymerization treatment (the first polymerization step) according to a usual procedure is added to an aqueous medium (e.g., an aqueous solution of a surfactant) and a monomer solution prepared by dissolving the crystalline material in a monomer is dispersed in a form of oil drop in the aqueous medium. Then, the aqueous dispersion system is subjected to a polymerization treatment (the second polymerization step) to form a covering layer (inter layer) comprising a resin (a polymer of the monomer) containing the crystalline material onto the surface of the resin particle (core particle). Thus a dispersion liquid of the composite resin particle (higher molecular weight resin-middle molecular weight resin) is prepared.

Next, a polymerization initiator and a monomer to form the low molecular weight resin are added to the dispersion liquid of the obtained composite resin particle, and the monomer is subjected to a polymerization treatment (the third polymerization step) in the presence of the composite resin particle to form a covering layer composed of the low molecular weight resin (a polymer of the monomer) onto the surface of the composite resin particle. It is preferable to incorporate the inter layer in the above-described method because the crystalline material can be finely and uniformly dispersed.

In one embodiment of the production method of the toner of the present invention, the polymerizable monomer is polymerized in the aqueous medium. Specifically, the crystalline material is dissolved in the monomer, and the obtained monomer solution is dispersed in a form of oil drop in the aqueous medium at the time of forming resin particles (core particles) or covering layer thereon (inter layer) containing the crystalline material, and resin particles can be obtained as latex particles by polymerization treatment with the addition of polymerization initiators into the system.

The aqueous medium means a medium comprising from 50% by mass to 100% by mass of water and from 0% by mass to 50% by mass of a water-soluble organic solvent. Examples of the water-soluble organic solvent include methanol, ethanol, isopropanol, butanol, acetone, methyl ethyl ketone and tetrahydrofuran. Of these, preferred is an alcohol based organic solvent which does not dissolve obtained resins.

As a preferable polymerization method to obtain resin particles or a covering layer containing the crystalline material, the following method (hereinafter referred to as a "mini-emulsion method") may be cited. A monomer solution prepared by dissolving the crystalline material in monomers is dispersed into an aqueous medium prepared by dissolving surfactants at a concentration of the critical micelle concentration or less so as to form oil droplets in water to prepare a dispersion liquid, while utilizing mechanical force. Subsequently, water-soluble polymerization initiators are added to the resulting dispersion liquid and the resulting mixture undergoes radical polymerization in oil droplets. This method is preferable because the effects of the present invention can be more exerted. Further, in the polymerization method, instead of using the water-soluble polymerization initiators, or along with the water-soluble polymerization initiators, oil-soluble polymerization initiators maybe used.

According to the mini-emulsion method in which oil droplets are formed mechanically, the crystalline material dissolved in oil phase scarcely desorbs and sufficient amount of the crystalline materials can be incorporated in a formed resin particle or a covering layer, unlike the ordinary emulsion polymerization method.

Herein, homogenizers to conduct oil droplet dispersion, employing mechanical forces, are not particularly limited, and include "CLEARMIX" (manufactured by M Tech Co., Ltd.) which is a stirring apparatus equipped with a high speed rotating rotator, ultrasonic homogenizers, mechanical homogenizers, Manton-Gaulin homogenizers and pressure type homogenizers. The size of dispersed particles is preferably 10 nm to 1,000 nm, and is more preferably 50 nm to 1000 nm, particularly preferably 30 nm to 300 nm.

A phase-separated structure of crystalline material in a toner particle, namely, the Feret's horizontal diameter, the shape coefficient and variation coefficient thereof, may be controlled by broadening the distribution of dispersed particle size.

As the other polymerization method to form a resin particle or covering layer containing the crystalline material, publicly known methods such as an emulsion polymerization method, a suspension polymerization method, a seed polymerization method, etc. may be employed. These polymerization methods can be also applied to forming a resin particle (core particle) or covering layer, which constructs the composite resin particle and which does not contain the crystalline material.

The particle size of composite resin particles obtained by the polymerization process is preferably from 10 to 1,000 nm in terms of mass average particle size determined employing an electrophoresis light scattering photometer "ELS-800" (produced by Ohtsuka Denshi Co.).

Further, glass transition temperature (Tg) of the composite resin particles is preferably from 48° C. to 74° C., and more preferably from 52° C. to 64° C.

The softening point of the composite resin particles is preferably from 95° C. to 140° C. The toner of the present invention can be obtained by fusing resin particles using a salting-out/fusion process to form a resin layer on a surface of resin and colored particle. This process is described below.

[Salting-out/Fusion Process]

The salting-out/fusion process is a process to obtain toner particles having an undefined shape (aspherical shape) in which the composite resin particles obtained by the above-described multi-step polymerization process and colorant particles are salted-out/fused (the processes of salting-out and fusion are induced simultaneously).

The salting-out/fusion process is that the processes of salting-out (aggregation of fine particles) and fusion (distinction of surface between the fine particles) occur simultaneously, or the processes of salting-out and fusion are induced simultaneously. Particles (composite resin particles and colorant particles) are preferably subjected to aggregation under such a temperature condition as higher than the glass transition temperature (Tg) of the resin constructing the composite resin particles so that the processes of salting-out and fusion are induced simultaneously.

In the salting-out/fusion process, particles of interior additives such as a charge control agent (fine particles having a number average primary particle size of about from 10 nm to 1,000 nm) may be salted-out/fused together with the composite resin particles and the colorant particles. Surface of the colorant particles may be modified by a surface modifier. As the surface modifier, a conventionally known one may be used.

(Ripening Process)

The ripening process is a process following the salting-out/fusion process, wherein the crystalline material is subjected to phase separation by continuing agitation with constant strength keeping temperature close to the melting point of the crystalline material, preferably plus minus 20° C. of the melting point, after the fusion of resin particles.

The Feret's horizontal diameter, the shape coefficient and variation coefficient of the crystalline material may be controlled in this process.

Further, in the present invention, the total concentration of divalent (or trivalent) metal elements employed in coagulants and univalent metal elements added as aggregation inhibiting agents, described below, is preferably from 350 to 35,000 ppm. It is possible to obtain the residual amount of metal ions in toner by measuring the intensity of fluorescent X-rays emitted from metal species of metal salts (e.g., calcium derived from calcium chloride) employed as coagulants, employing a fluorescence X-ray analyzer "System 3270 Type" (manufactured by Rigaku Denki Kogyo Co., Ltd.). One specific measurement method is as follows. A plurality of toners comprising coagulant metal salts, whose content ratios are known, are prepared, and 5 g of each toner is pelletized. Then, the relationship (a calibration curve) between the content ratio (ppm by mass) of the coagulant metal salts and the fluorescent X-ray intensity (being its peak intensity) from the metal species of the metal salt is determined. Subsequently, a toner (a sample), whose content ratio of the coagulant metal salt is to be measured, is pelletized in the same manner and fluorescent X-ray intensity emitted from the metal species of the coagulant metal salt is measured, whereby it is possible to obtain the content ratio, namely, "residual amount of metal ions in the toner".

(Filtration and Washing Process)

In the filtration and washing process, filtration is carried out in which the toner particles are collected from the dispersion system of the toner particle obtained in the above-described step, and washing is also carried out in which deposit such as surfactants and salting-out agents are removed from the collected toner particles (a cake-like aggregate). Herein, filtering methods are not particularly limited, and include a centrifugal separation method, a reduced pressure filtration method employing Nutsche, etc., and a filtration method employing a filter press, etc.

[Drying Process]

This process is a process to dry toner particles which have been subjected to the washing treatment.

Examples of the dryers employed in this process include a spray dryer, a vacuum-freeze dryer and a reduced pressure dryer. It is preferred to employ a stationary tray dryer, a movable tray dryer, a fluidized-bed dryer, a rotating type dryer, a stirring type dryer, etc.

It is proposed that the moisture content of dried toner particles is preferably 5% by mass or less, and is more preferably 2% by mass or less.

Further, when dried toner particles are aggregated due to weak attractive forces among particles, the aggregates may be subjected to crushing treatment. Herein, employed as crushing devices may be mechanical crushing devices such as a jet mill, a Henschel mixer, a coffee mill and a food processor.

The toner according to the present invention is preferably produced by the following procedure, in which the composite resin particle is formed in the presence of no colorant, a dispersion liquid of the colorant particles is added to the dispersion liquid of the composite resin particles and the composite resin particles and the colorant particles are salted-out and fused.

In the foregoing procedure, the polymerization reaction to obtain the composite resin particle is not inhibited since the preparation of the composite resin particle is performed in the system without colorant. Consequently, according to the toner of the present invention, the excellent anti-offset property is not deteriorated and contamination of the fixing apparatus and the image caused by the accumulation of the toner is not caused.

Moreover, the monomer or the oligomer does not remain in the obtained toner particle since the polymerization reaction for forming the composite resin particle is completely performed. Consequently, any offensive odor is not generated in the heat-fixing process in the image forming method using the toner.

Further, the surface property of thus produced toner particle is uniform and the charge amount distribution of the toner becomes narrow. Accordingly, an image with a high sharpness can be formed over a long period of time. By employing such a toner which is uniform in the composition, molecular weight and the surface property of each particles, the anti-offset and anti-winding properties can be improved and an image with suitable glossiness can be formed while keeping a suitable adhesiveness (a high fixing strength) to the image support in the image forming method including a fixing process by contact heating system.

Further, preferably employed as the fixing improver may be a crystalline compound having an ester group. Specific examples thereof include higher fatty acid ester, natural waxes such as carnauba wax, rice wax, etc. and crystalline polyester.

Among the compounds having an ester group, an ester compound represented by the following General Formula (2) is particularly preferably used.

$$R_1—(OCO—R_2)_n \qquad \text{General Formula (2)}$$

wherein n represents an integer of 1 to 4, and preferably 2 to 4, more preferably 3 or 4, and particularly preferably 4.

$R_1$ and $R_2$ each represents a hydrocarbon group which may have a substituent, respectively.

$R_1$ has from 1 to 40 carbon atoms, and preferably 1 to 20, more preferably 2 to 5.

$R_2$ has from 1 to 40 carbon atoms, and preferably 13 to 29, more preferably 12 to 25.

Specific examples of the crystalline compounds having an ester group are described below, however, the present invention is not limited thereto.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}-CH_3$

-continued

7)

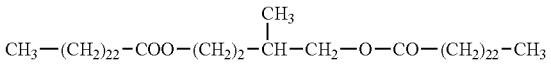

8)

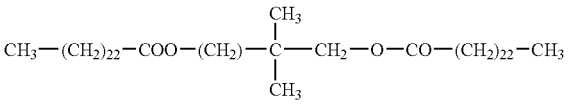

9)

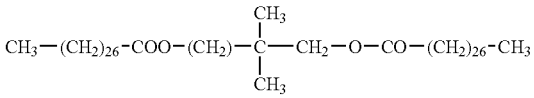

10)

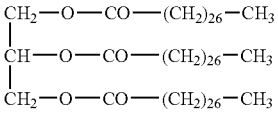

11)

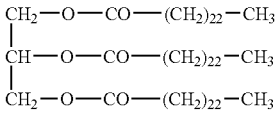

12)

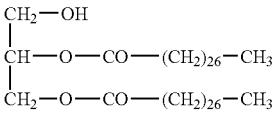

13)

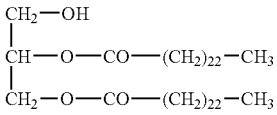

14)

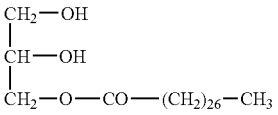

15)

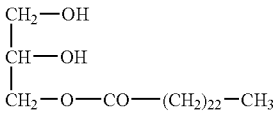

16)

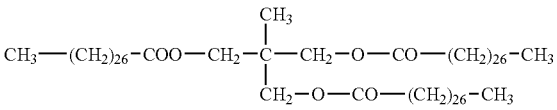

17)

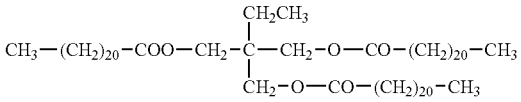

18)

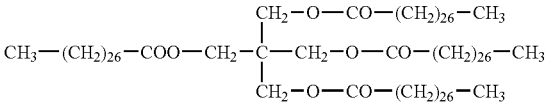

19)

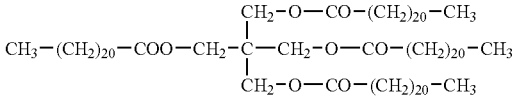

20)

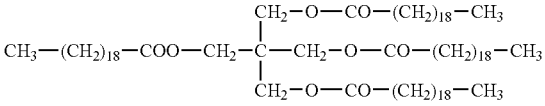

21)

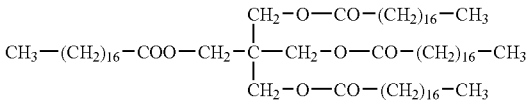

The crystalline compounds having an ester group are incorporated into resin particles and have a function providing excellent fixability (adhesiveness to an image support) for the toner which is obtained by fusing the resin particles.

The melting point of the crystalline compounds described above is preferably from 60 to 110° C., and is more preferably from 70 to 90° C.

When the crystalline compound with an ester group, having a melting point in the range of 60 to 110° C., is employed, it is possible to lower the entire melt viscosity of the obtained toner, and it is also possible to attempt the enhancement of adhesiveness to paper, etc. In addition, even though the crystalline compounds are present, the elastic modulus in the high-temperature range is maintained within a preferable level. Thus excellent anti-offset property can be obtained.

The melting point of the crystalline compound as described herein means a value measured by a differential scanning calorimeter (DSC). In concrete, when temperature increases (the first temperature raising process) at a rate of 10° C./minute from 0° C. to 200° C., the temperature, which shows the maximum peak of measured endothermic peaks, is designated as a melting point. The melting point is equal to the above-described "the endothermic peak of the toner in a differential thermal analysis".

The number average molecular weight of the crystalline polyester is preferably from 1,500 to 15,000, and is more preferably from 2,000 to 10,000.

In the toner obtained employing crystalline polyester having a number average molecular weight of 1,500 to 15,000, compatibility with binder resins (amorphous polymers) which are employed to realize a total decrease in the melt viscosity is improved in a molten state, and thus the fixability in the lower temperature range is enhanced.

Herein, the number average molecular weight of the crystalline polyester means a value determined from a molecular weight measured according to the following conditions.

(Condition)

Model of machine employed: "LC-6A" (manufactured by Shimadzu Corp.)

Column: "Ultrastyragel Plus"

Analysis temperature: 60° C.

Solvent: m-cresol/chlorobenzene=3/1

(Volume Ratio)

Calibration curve: Standard polystyrene calibration curve

When crystalline polyester is employed as the crystalline compound having an ester group, it is preferable that melt viscosity of the crystalline polyester (melt viscosity at melting point+20° C.) is 300 dPa·s or less and more preferably 250 dPa·s or less.

When crystalline polyester having melt viscosity of 300 dPa·s or less is employed, melt viscosity as a whole including the binder resin can be lowered, and fixability is improved in a provided-toner.

Herein, melt viscosity of the crystalline polyester (melt viscosity at melting point+20° C.) means a value measured by a cone plate viscometer.

A peak molecular weight of the crystalline polyester measured by GPC is preferably from 6,000 to 50,000. Further, preferably employed as the crystalline polyester is one exhibiting an endothermic peak (P1) in the range of 60° C. to 120° C. during the first temperature raising process, as measured with a DSC.

The binder resin is described. A hydrophobic monomer is essentially used as the polymerizable monomer for producing the binder resin and a cross-linkable monomer is used according to necessity. As is described below, it is preferable to contain at least one kind of a monomer having an acidic polar group or a monomer having a basic polar group in the structure.

(1) Hydrophobic Monomer

The hydrophobic monomers constructing a monomer component are not particularly limited and a conventionally known monomer can be used. In addition, for satisfying required properties, the hydrophobic monomers can be used individually or in combination of two types or more.

Specifically, employed may be monovinyl aromatic monomers, acrylic acid ester based monomers, methacrylic acid ester based monomers, vinyl ester based monomers, vinyl ether based monomers, monoolefin based monomers, diolefin based monomers, halogenated olefin based monomers, etc.

Examples of the vinyl aromatic monomers include styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne and 3,4-dichlorostyrene.

Examples of the (meth)acrylic acid ester based monomers include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl Y-aminoacrylate, stearyl methacrylate, dimethyl aminoethyl methacrylate and diethyl aminoethyl methacrylate.

Examples of the vinyl ester based monomers include vinyl acetate, vinyl propionate, vinyl benzoate, etc. Examples of the vinyl ether based monomers include vinyl methyl ether, vinyl ethyl ether, vinyl isobutyl ether and vinyl phenyl ether.

Examples of the monoolefin based monomers include ethylene, propylene, isobutylene, 1-butene, 1-pentene, 4-methyl-1-pentene, etc. Examples of the diolefin based monomers include butadiene, isoprene and chloroprene.

(2) Crosslinking Monomers

In order to improve the properties of resin particles, crosslinking monomers may be added. Examples of the crosslinking monomers include those having at least two unsaturated bonds such as divinylbenzene, divinylnaphthalene, divinyl ether, diethylene glycol methacrylate, ethylene glycol dimethacrylate, polyethylene glycol dimethacrylate and diallyl phthalate.

(3) Monomer Having an Acidic Polar Group

As the monomer having an acidic polar group, (a) an α, β-ethylenically unsaturated compound containing a carboxyl group (—COOH) and (b) an α, β-ethylenically unsaturated compound containing a sulfonic group (—$SO_3H$) can be cited.

Examples of the α, β-ethylenically unsaturated compound containing the carboxyl group described in (a) include acrylic acid, methacrylic acid, fumaric acid, maleic acid, itaconic acid, cinnamic acid, maleic acid mono-butyl ester, maleic acid mono-octyl ester and their metal salts such as sodium salts, zinc salts, etc.

Examples of the α, β-ethylenically unsaturated compound containing the sulfonic group described in (b) include sulfonated styrene and its sodium salt, allylsulfo succinic acid, allylsulfo succinic acid octyl ester and their sodium salts.

(4) Monomer Having a Basic Polar Group

Examples of the monomer having a basic polar group include (a) (meth)acrylic acid ester obtained by reacting (meth)acrylic acid with an aliphatic alcohol, which has 1 to 12 carbon atoms, preferably 2 to 8 carbon atoms, particularly preferably 2 carbon atoms, and which also has an amine group or a quaternary ammonium group, (b) (meth) acrylic acid amide or (meth)acrylic acid amide having mono-alkyl group or di-alkyl group, having 1 to 18 carbon atoms, substituted on its nitrogen atom, (c) vinyl compound substituted with a heterocyclic group having at least a nitrogen atom in the heterocyclic group, (d) N,N-diallylalkylamine or its quaternary ammonium salt. Of these, (a) (meth)acrylic acid ester obtained by reacting (meth)acrylic acid with the aliphatic alcohol having the amine group or the quaternary ammonium group is preferred as the monomer having a basic polar group.

Examples of the (meth)acrylic acid ester obtained by reacting (meth)acrylic acid with the aliphatic alcohol having the amine group or the quaternary ammonium group described in (a) include dimethylaminoethylacrylate, dimethylaminoethylmethacrylate, diethylaminoethylacrylate, diethylaminoethylmethacrylate, quaternary ammonium salts of the above-described four compounds, 3-dimethylaminophenylacrylate and 2-hydroxy-3-methacryloxypropyl trimethylammonium salt.

Examples of the (meth)acrylic acid amide or (meth) acrylic acid amide mono- or di-alkyl substituted on its nitrogen atom described in (b) include acrylamide, N-butylacrylamide, N,N-dibutylacrylamide, piperidylacrylamide, methacrylamide, N-butylmethacrylamide, N,N-dimethylacrylamide and N-octadecylacrylamide.

Examples of the vinyl compound substituted with a heterocyclic group having a nitrogen atom in the heterocyclic group described in (c) include vinylpyridine, vinylpyrrolidone, vinyl-N-methylpyridinium chloride and vinyl-N-ethylpyridinium chloride.

Examples of the N,N-diallyl-alkylamine described in (d) include N,N-diallyl-methylammonium chloride and N,N-diallyl-ethylammonium chloride.

(Polymerization Initiators)

Radical polymerization initiators may be suitably employed in the present invention, as long as they are water-soluble. Examples thereof include persulfate salts (e.g., potassium persulfate, ammonium persulfate, etc.), azo based compounds (e.g., 4,4'-azobis-4-cyanovaleric acid and salts thereof, 2,2'-azobis(2-amidinopropane) salts, etc.) and peroxides. Further, if desired, it is possible to employ the radical polymerization initiators as redox based initiators by combining them with reducing agents. By employing the redox based initiators, it is possible to increase polymerization activity and decrease polymerization temperature so that decrease in polymerization time is realized.

It is possible to select any polymerization temperature, as long as it is higher than or equal to the lowest radical formation temperature of the polymerization initiator. For example, the temperature in the range of 50° C. to 90° C. is employed. However, by employing a combination of polymerization initiators such as hydrogen peroxide-reducing agent (ascorbic acid, etc.), which is capable of initiating polymerization at room temperature, it is possible to carry out the polymerization at room temperature or higher.

(Chain Transfer Agents)

For the purpose of regulating the molecular weight of resin particles, it is possible to employ commonly known chain transfer agents. The chain transfer agent is not particularly limited, however, for example, employed is a compound having a mercapto group such as octylmercaptan, dodecylmercaptan and tert-dodecylmercaptan. Particularly, the compound having a mercapto group is preferably employed to give an advantageous toner having such characteristics as reduced smell at the time of heat-fixing, sharp molecular weight distribution, good preservability, fixing strength and anti-offset. Preferable examples of the compounds include ethyl thioglycolate, propyl thioglycolate, butyl thioglycolate, t-butyl thioglycolate, 2-ethylhexyl thioglycolate, octyl thioglycolate, decyl thioglycolate, dodecyl thioglycolate, an ethyleneglycol compound having a mercapto group, a neopentyl glycol compound having a mercapto group, and a pentaerythritol compound having a mercapto group. Among these, n-octyl-3-mercaptopropionic acid ester is particularly preferable in view of minimizing smell at the time of heat-fixing.

(Surfactants)

In order to perform the mini-emulsion polymerization employing the above-described polymerizable monomers, it is preferred to conduct oil droplet dispersion in an aqueous medium employing surfactants. Surfactants, which are employed for the dispersion, are not particularly limited, and it is possible to cite ionic surfactants described below as suitable ones.

Examples of the ionic surfactants include sulfonic acid salts (sodium dodecylbenzenesulfonate, sodium aryl alkyl polyethersulfonate, sodium 3,3-disulfonediphenylurea-4,4-diazo-bis-amino-8-naphthol-6-sulfonate, sodium ortho-carboxybenzene-azo-dimethylaniline-2,2,5,5-tetramethy 1-triphenylmethane-4,4-diazo-bis-β-naphthol-6-sulfonate, etc.), sulfuric acid ester salts (sodium dodecylsulfonate, sodium tetradecylsulfonate, sodium pentadecylsulfonate, sodium octylsulfonate, etc.) and fatty acid salts (sodium oleate, sodium laurate, sodium caprate, sodium caprylate, sodium caproate, potassium stearate, calcium oleate, etc.).

In the present invention, surfactants represented by the following formulae (a) and (b) are particularly preferably employed.

$$R^1(OR^2)_nOSO_3M \qquad \text{formula (a)}$$

$$R^1(OR^2)_nSO_3M \qquad \text{formula (b)}$$

In formulae (a) and (b), $R^1$ represents an alkyl group having from 6 to 22 carbon atoms or an arylalkyl group, $R^1$ is preferably an alkyl group having from 8 to 20 carbon atoms or an arylalkyl group and is more preferably an alkyl group having from 9 to 16 carbon atoms or an arylalkyl group.

Examples of the alkyl group having from 6 to 22 carbon atoms represented by $R^1$ include an n-hexyl group, an n-heptyl group, an n-octyl group, an n-decyl group, an n-undecyl group, an n-hexadecyl group, a cyclopropyl group, a cyclopentyl group, and a cyclohexyl group. Examples of the arylalkyl group represented by $R^1$ include a benzyl group, a diphenylmethyl group, a cinnamyl group, a styryl group, a trityl group, and a phenethyl group.

In formulae (a) and (b), $R^2$ represents an alkylene group having from 2 to 6 carbon atoms. $R^2$ is preferably an alkylene group having 2 or 3 carbon atoms. Examples of the alkylene groups having from 2 to 6 carbon atoms represented by $R^2$ include an ethylene group, a trimethylene group, a tetramethylene group, a propylene group, and an ethylethylene group.

In formulae (a) and (b), n is an integer of 1 to 11; and n is preferably from 2 to 10, is more preferably from 2 to 5, and is particularly preferably 2 or 3.

In formulae (a) and (b), examples of the univalent metal elements represented by M include sodium, potassium, and lithium. Of these, sodium is preferably employed.

Specific examples of surfactants represented by formulae (a) and (b) are described below, however, the present invention is not limited thereto:

$C_{10}H_{21}(OCH_2CH_2)_2OSO_3Na$ Compound (101):

$C_{10}H_{21}(OCH_2CH_2)_3OSO_3Na$ Compound (102):

$C_{10}H_{21}(OCH_2CH_2)_2SO_3Na$ Compound (103):

$C_{10}H_{21}(OCH_2CH_2)_3SO_3Na$ Compound (104):

$C_8H_{17}(OCH_2CH(CH_3))_2OSO_3Na$ Compound (105):

$C_{18}H_{37}(OCH_2CH_2)_2OSO_3Na$ Compound (106):

In the present invention, from the viewpoint of maintaining the charge holding function of toner in the desired state, minimizing fog under a high temperature and high humidity, and improving transferability, as well as minimizing an increase in charge amount under a low temperature and low humidity, and stabilizing the development amount, the content of the surfactants represented by the above-described formulae (a) and (b) in the electrostatic image developing toner is preferably from 1 ppm to 1,000 ppm, is more preferably from 5 ppm to 500 ppm, and is particularly preferably from 7 ppm to 100 ppm.

In the present invention, by adjusting the amount of the surfactants incorporated into the toner to the above-described range, the charging property of the electrostatic image developing toner of the present invention is built up being independent of ambience, and can be always provided and maintained uniformly and stably.

Further, the content of the surfactants represented by the above-described formulae (a) and (b) incorporated in the electrostatic image developing toner of the present invention is calculated employing the method described below.

1 g of toner is dissolved in 50 ml of chloroform, and surfactants are extracted from the chloroform layer employing 100 ml of ion-exchanged water. Further, the chloroform layer, which has been extracted, is further extracted employing 100 ml of ion-exchanged water, whereby 200 ml in total of extract (being a water layer) is obtained, which is diluted to 500 ml.

The resulting diluted solution is employed as a test solution which is subjected to coloration utilizing Methylene Blue based on the method specified in JIS 33636. Then, its absorbance is determined, and the content of the surfactants in the toner is determined employing the independently prepared calibration curve.

Further, the above-described extract is analyzed employing $^{1}$H—NMR, and the structure of the surfactants represented by formulae (a) and (b) is determined.

In the present invention, metal salts may be employed preferably as coagulants in the process where resin particles are salted-out, aggregated and fused from the dispersion liquid of the resin particles prepared in an aqueous medium. Divalent or trivalent metal salts are more preferably employed as the coagulants. This is because the divalent or trivalent metal salts are better than univalent metal salts since they have low critical coagulation concentration (coagulation value or coagulation point).

Nonionic surfactants may also be employed in the present invention. Specific examples thereof include polyethyleneoxide, polypropyleneoxide, a combination of polyethyleneoxide and polypropyleneoxide, an ester of polyethyleneglycol with higher fatty acid, alkylphenolpolyethyleneoxide, an ester of polyethyleneglycol with higher fatty acid, an ester of polypropyleneoxide with higher fatty acid and sorbitan ester.

In the present invention, these surfactants are employed mainly as an emulsifier at the time of emulsion polymerization, and may be used for other purpose or in the other process.

(Molecular Weight Distribution of Resin Particles and Toner)

The toner of the present invention has a peak or a shoulder within the range of preferably from 100,000 to 1,000,000 and from 1,000 to 50,000, and more preferably in the range of from 100,000 to 1,000,000, from 25,000 to 150,000 and from 1,000 to 50,000 in the molecular weight distribution.

The resin particles preferably comprises at least a high molecular weight resin having a peak or a shoulder within the range of from 100,000 to 1,000,000, and a low molecular weight resin having a peak or a shoulder within the range of from 1,000 to less than 50,000, and more preferably a middle molecular weight resin having a peak or a shoulder within the range of from 15,000 to 100,000, in the molecular weight distribution.

The molecular weight of the toners or particles is preferably measured by gel permeation chromatography (GPC) employing tetrahydrofuran (THF) as a solvent. 1.0 ml of THF is added to a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.45 to 0.50 μm, the filtrate is injected in a GPC. Measurement conditions of GPC are described below. A column is stabilized at 40° C., and THF is flowed at a rate of 1.0 ml per minute. Then measurement is carried out by injecting approximately 100 μl of the sample at a concentration of 1 mg/ml. It is preferable that commercially available polystyrene gel columns are used in combination thereof. For example, it is possible to cite combinations of Shodex GPC KF-801, 802, 803, 804, 805, 806, and 807, produced by Showa Denko Co., or combinations of TSK gel G1000H, G2000H, G3000H, G4000H, G5000H, G6000H, G7000H, TSK guard column, etc., produced by Tosoh Corporation. Further, as a detector, a refractive index detector (IR detector) or a UV detector is preferably employed. When the molecular weight of samples is measured, the molecular weight distribution of the sample is calculated employing a calibration curve which is prepared employing monodisperse polystyrene as standard particles. Approximately ten polystyrenes samples may be preferably employed for preparing the calibration curve.

(Coagulants)

In the present invention, metal salts may be employed preferably as coagulants in the process where resin particles are salted-out, aggregated and fused from the dispersion liquid of the resin particles prepared in an aqueous medium. Divalent or trivalent metal salts are more preferably employed as the coagulants. This is because the divalent or trivalent metal salts are better than univalent metal salts since they have low critical coagulation concentration (coagulation value or coagulation point).

Examples of the coagulants usable in the present invention include salts of univalent alkali metals such as sodium, potassium and lithium; salts of alkali earth metals such as calcium and magnesium; salts of divalent metals such as manganese and copper; and salts of trivalent metals such as iron and aluminum.

Specific examples of these metal salts are described below. Examples of the univalent metal salts include sodium chloride, potassium chloride, lithium chloride, etc.; while examples of the divalent metal salts include calcium chloride, zinc chloride, copper sulfate, magnesium sulfate, manganese sulfate, etc., and examples of the trivalent metal salts include aluminum chloride, iron chloride, etc. Any of these are suitably selected in accordance with the application, and the divalent or trivalent metal salt is preferable because of low critical coagulation concentration.

The critical coagulation concentration is an index of the stability of dispersed materials in an aqueous dispersion liquid, and shows the concentration of coagulants at which coagulants are added to initiate aggregation. This critical coagulation concentration varies greatly depending on the latex itself as well as dispersants, for example, as described in Seizo Okamura, et al., Kobunshi Kagaku (Polymer Chemistry), Vol. 17, page 601 (1960), etc., and the value can be obtained with reference to the above-described publications. Further, as another method, the critical coagulation concentration may be obtained as described below. A desired salt is added to an objective particle dispersion liquid while changing the salt concentration to measure the ζ potential of the dispersion liquid, and in addition the critical coagulation concentration may be obtained as the salt concentration which initiates a variation in the ζ potential.

In the present invention, the polymer fine particles dispersion liquid is processed by employing metal salts so as to have concentration not less than critical coagulation concentration. In this instance the metal salt is added directly or in a form of aqueous solution optionally, which is determined according to the purpose. In the case that it is added in an aqueous solution, the added metal salt must satisfy the critical coagulation concentration or more of the polymer particles, based on the total volume of polymer particle dispersion liquid and aqueous metal salt solution.

In the present invention, the concentration of metal salts may be the critical coagulation concentration or more. However, the concentration is preferably 1.2 times or more, and more preferably 1.5 times or more of the critical coagulation concentration.

The image forming method of the present invention is described. In the present invention, the image forming method comprises the steps of visualizing an electrostatic latent image formed on a photoreceptor, transferring the visualized image onto a recording medium, and heat-fixing the image, wherein the heat-fixing is preferably performed by use of a fixing device having an endless belt-shaped film or a fixing device using ended films. Herein, the toner used for the above-described visualization is the electrostatic image developing toner of the present invention.

As one example of the fixing device having an endless belt-shaped film, which is used for the heat-fixing, preferably used is, for example, a method in which fixing is carried out employing a rotating pressure applying member including a heating body fixedly arranged.

The fixing method is a pressure contact heat-fixing method employing a fixedly arranged heating body and a pressing applying member which is brought into face-to-face pressure contact with the fixed heating body and brings a transferring material into close contact with the heating body via a film.

This pressure contact heat-fixing device comprises a heating body which has smaller heat capacity compared to conventional heating rollers, and has a line-shaped heating section perpendicular to the conveying direction of the transfer material. It is preferred that the maximum temperature of the heating section is generally adjusted to 100° C. to 300° C.

Further, the pressure contact heat-fixing as described herein is a method in which a toner image which is not yet fixed is brought into pressure contact with a heating source to accomplish fixing, in such methods that a transfer material holding a toner image, which has not yet been fixed, is conveyed between the heating member and the pressing member, and the like. According to such a method, heating is rapidly carried out, as a result, it is possible to accomplish high speed fixing. However, it is difficult to control temperature, and toner adheres and remains on the portion with which toner, which has not yet been fixed, on the surface portion of the heat source is directly brought into pressure contact. As a result, there arise problems that troubles tend to occur in which so-called toner offsetting is likely to occur and transfer materials are wound on the fixing device, and the like.

In this fixing method, the low-heat capacity line-shaped heating body fixed in the device is prepared by coating a resistance material of 1.0 mm to 2.5 mm onto an alumina substrate having preferably a thickness of 0.2 mm to 5.0 mm, and more preferably 0.5 mm to 3.5 mm, a width of 10 mm to 15 mm, a longitudinal length of 240 mm to 400 mm, and an electric current is provided to both ends of the line-shaped heating body.

The electric current has DC 100 V with a pulse waveform of a 15 millisecond cycle to 25 millisecond cycle and is supplied upon varying to the pulse width in response to the emission amount of temperature/heat energy controlled by a temperature sensor. In the low-heat capacity line-shaped heating body, temperature measured by the temperature sensor is denoted as T1, while when the surface temperature of film faced against a resistance material is denoted as T2, T2 becomes lower than T1. Herein, T1 is preferably from 120° C. to 220° C., and T2 is preferably from 0.5° C. to 10° C. lower than T1. Furthermore, when the surface temperature of a film material at a portion at which the film is peeled from the toner surface is denoted as T3, T3 is nearly equal to T2.

Preferably employed as these films for fixing are endless films, composed of 10 μm to 35 μm thick heat-resistant film such as polyester, polyperfluoroalkoxyvinyl ether, polyimide, polyetherimide, etc., which is in many cases coated with a 5 μm to 15 μm thick releasing agent layer prepared by adding an electroconductive material to a fluorine resin such as Teflon (R), etc.

The film is subjected to driving force and tension employing a driving roller and a driven roller, and is then conveyed in the arrow direction without allowing wrinkling nor slippage. The line speed in the fixing device is preferably from 230 mm/second to 900 mm/second.

Pressure rollers comprise a rubber elastic layer with high releasing properties, which is composed of silicone rubber and the like, are brought into contact with a heating body via a film material, and is rotated under pressure contact.

Figure 5A:
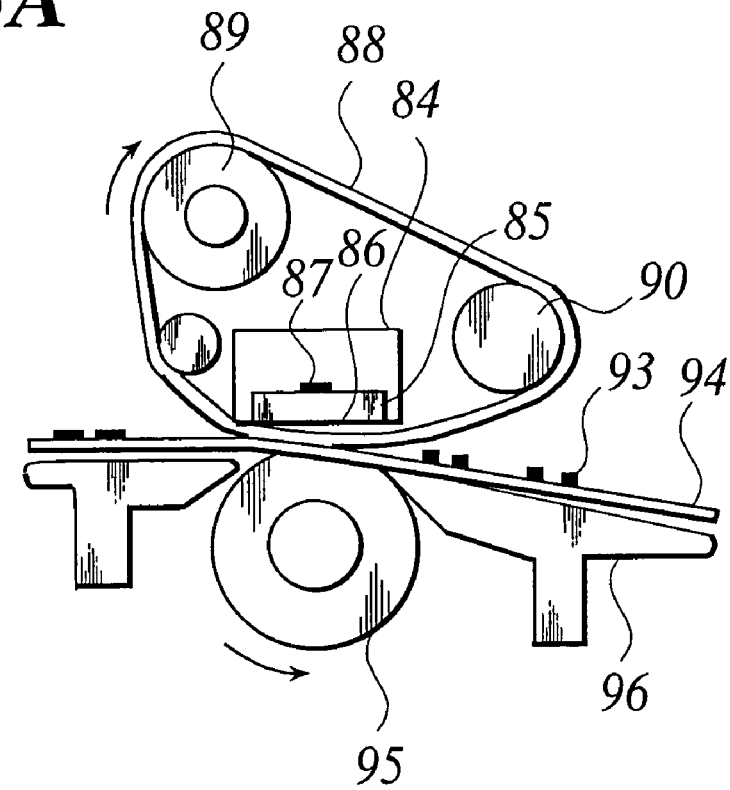
FIGS. 5A and 5B are explanatory construction views showing one example of a construction of the fixing device.
Figure 5B:
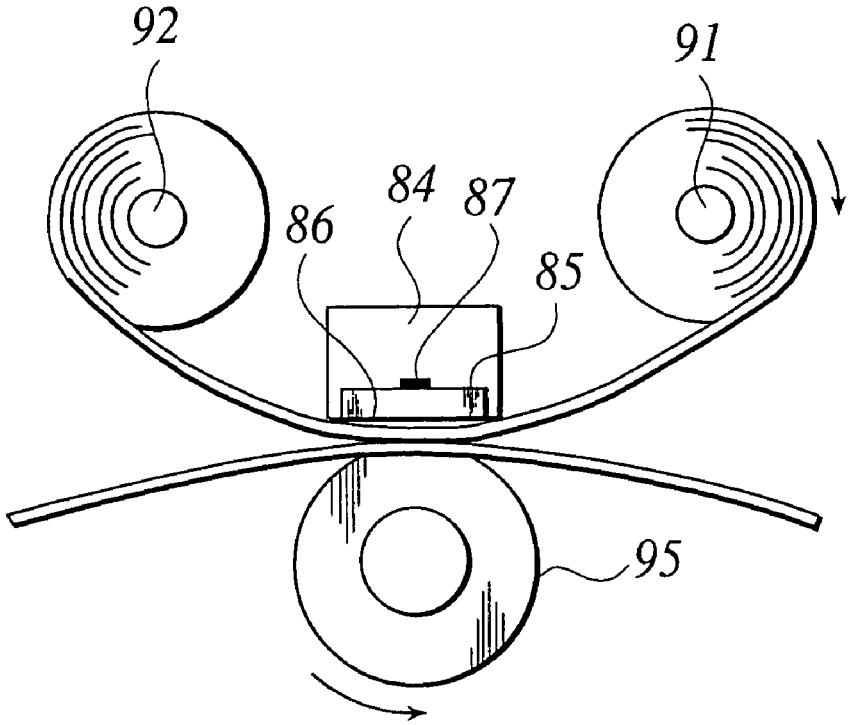

In the present invention, preferably used are the example as shown in FIG. 5A, in which an endless film is employed, or the construction as shown in FIG. 5B, in which a film sheet feeding shaft and winding shaft are used and ended film materials is used. Further, a simple cylindrical one may be employed, which has no driving roller, or the like, in its interior.

The fixing device may be provided with a cleaning mechanism. Employed as cleaning methods are a method in which various types of silicone oil are supplied to a fixing film, or a method in which cleaning is carried out employing a pad impregnated with various silicone oils, a roller, a web, etc.

Incidentally, as silicone oil, it is possible to employ polydimethylsiloxane, polymethylphenylsiloxane, polydiphenylsiloxane, etc. Further, it is possible to suitably use siloxanes comprising fluorine.

Herein, an example of the cross-sectional construction view of the fixing device according to the present invention is described in detail by referring to FIGS. 5A and 5B.

In FIG. 5A, reference numeral 84 is a low-heat capacity line-shaped heating body which is fixed in the device. One example is prepared by coating a 1.0 mm width resistance material 86 onto an alumina substrate 85 having a height of 1.0 mm, a width of 10 mm, and a longitudinal length of 240 mm, and an electric current is supplied to both ends in the longitudinal direction.

The electric current having, for example, DC 100 V with a pulse waveform of a 20 millisecond cycle is generally supplied, and a specific temperature is controlled employing signals from a temperature detecting element 87 and maintained at a predetermined temperature. Owing to that, the pulse width varies in response to an emission amount of energy, at a range of, for example, from 0.5 millisecond to 5 millisecond. A transfer material 94 holding a toner image 93, which has not yet been fixed, is brought into pressure contact with the thus controlled heating body 84 via a film 88 conveyed and thereby accomplishing heat-fixing of the toner.

The film 88 employed herein is subjected to tension employing a driving roller 89 and a driven roller 90, and conveyed without the formation of wrinkling. Reference numeral 95 is a pressure roller comprising a rubber elastic layer formed of silicone rubber and the like, which presses the heating body via a film under a total pressure of 0.4 N to 2.0 N. The toner image 93, which has not yet been fixed, on the transfer material 94, is led to a fixing section employing an inlet guide 96, and is heated to obtain a fixed image.

In the above, description is made employing an endless belt. However, as shown in FIG. 5B, in the present invention, a film with both ends may also be employed as a film for fixing utilizing a film sheet feeding shaft 91 and a winding shaft 92.

Next, an image forming apparatus used for the image forming method of the present invention is described. In the present invention, a plurality of images are formed by repeating each step of charging on a photoreceptor, forming an electrostatic latent image on the photoreceptor through an image exposure, developing the electrostatic latent image using a developer, transferring the formed toner image to a transfer material using a contact transfer system, separating the image transfer material, fixing the toner image, and cleaning the surface of the photoreceptor.

(Transferring Roller)

The toner image is transferred from the surface of the photoreceptor to the transfer material by pressure of the transferring roller which is elastically pressed to the photoreceptor while applying a bias voltage. As the transferring roller, an elastic body comprising rubber or a porous foamed material is usable. Examples of the transferring roller include various types of transferring rollers such as (1) an ion-conductive type roller manufactured by Bridgestone Co., Ltd., (2) an electron-conductive type roller manufactured by Bridgestone Co., Ltd., (3) a Rubycell-type urethane foams roller manufactured by Toyo Polymer Co., Ltd., (4) an ion-conductive type roller manufactured by Sumitomo Rubber Co., Ltd., (5) EPDM type roller manufactured by Sumitomo Rubber Co., Ltd., (6) an epichlorohydrin type roller manufactured by Sumitomo Rubber Co., Ltd., (7) an ENDUR ion-conductive type roller manufactured by INOAC Corp., (8) a foamed silicone type roller manufactured by Tigers Polymer Co., Ltd., (9) a foamed urethane type roller manufactured by Hokushin Kogyo Co., (10) a foamed silicone type roller manufactured by Shinetsu Polymer Co., Ltd, or (11) a carbon black containing Rubycell foamed polyurethane type roller manufactured by Nitto Kogyo Co., Ltd. Among them, foamed ones are preferred.

In the image forming method of the present invention, the pressure of the transferring roller against the photoreceptor is preferably from 2.5 kPa to 100 kPa, more preferably from 10 kPa to 80 kPa in order to preferably transfer the toner image on the photoreceptor surface to the transfer material.

When the pressure is from 2.5 kPa to 100 kPa, the transferring of toner image is sufficiently performed, a crystalline material having releasability in the toner can be prevented from being transferred on the photoreceptor surface and the formation of image defects can also be prevented. Further, shock caused by releasing of the pressure of the transferring roller is reduced, and therefore, image defects caused by transfer slipping can be prevented and damage on the photoreceptor caused by the shock can also be prevented.

Further, as the properties required to the transferring roller, for example, an impact resilience, electric resistivity, surface hardness, etc. are important. The impact resilience of the elastic body as the transferring roller is preferably from 30% to 70%. When the impact resilience is from 30% to 70%, a good transfer rate can be obtained because the pressure against the photoreceptor can be sufficiently obtained in the toner image transfer, and the formation of image defects such as transfer slippage can be prevented because impact at the transferring can be decreased. The impact resilience is determined in accordance with the measurement method described in JIS K7311.

The transferring roller must have an appropriate electric conductivity so that a bias voltage can be applied for the transferring of toner image. The preferable electric resistivity of the roller measured by the following measurement method is $1\times10^{3}$ Ω to $1\times10^{13}$ Ω.

(Measurement Method)

A transferring roller comprising a rotating shaft with a diameter of 16 mm and a length of 310 mm, and an elastic body with a thickness of 4 mm provided on the rotating shaft is prepared. The roller is pressed with a pressure of 17 kPa to an aluminum drum with a diameter of 30 mm. The electric resistivity between the rotating shaft of the transferring roller and the aluminum drum is measured under an environment of 20° C. and RH of 50%.

Further, it is preferred that the surface of the elastic body has a hardness measured by Ascar C Hardness Meter of 20 degree to 70 degree. The transferring roller comprising the elastic body having the Ascar C Hardness of 20 degree to 70 degree is preferable because the image transfer can be carried out appropriately and image defects caused by transfer slippage are avoided.

Next, the image forming apparatus used for the image forming method for forming a plurality of images of the present invention is described by referring to figures. The image forming method for forming a plurality of images of the present invention means a method for forming a plurality of images by repeating each step of charging on a photoreceptor, forming an electrostatic latent image on the photoreceptor through an image exposure, developing the electrostatic latent image using a developer containing an electrostatic latent image developing toner, transferring the formed toner image to a transfer material using a contact transfer system, separating the image transfer material, fixing the toner image, and cleaning the surface of the photoreceptor.

Figure 6:
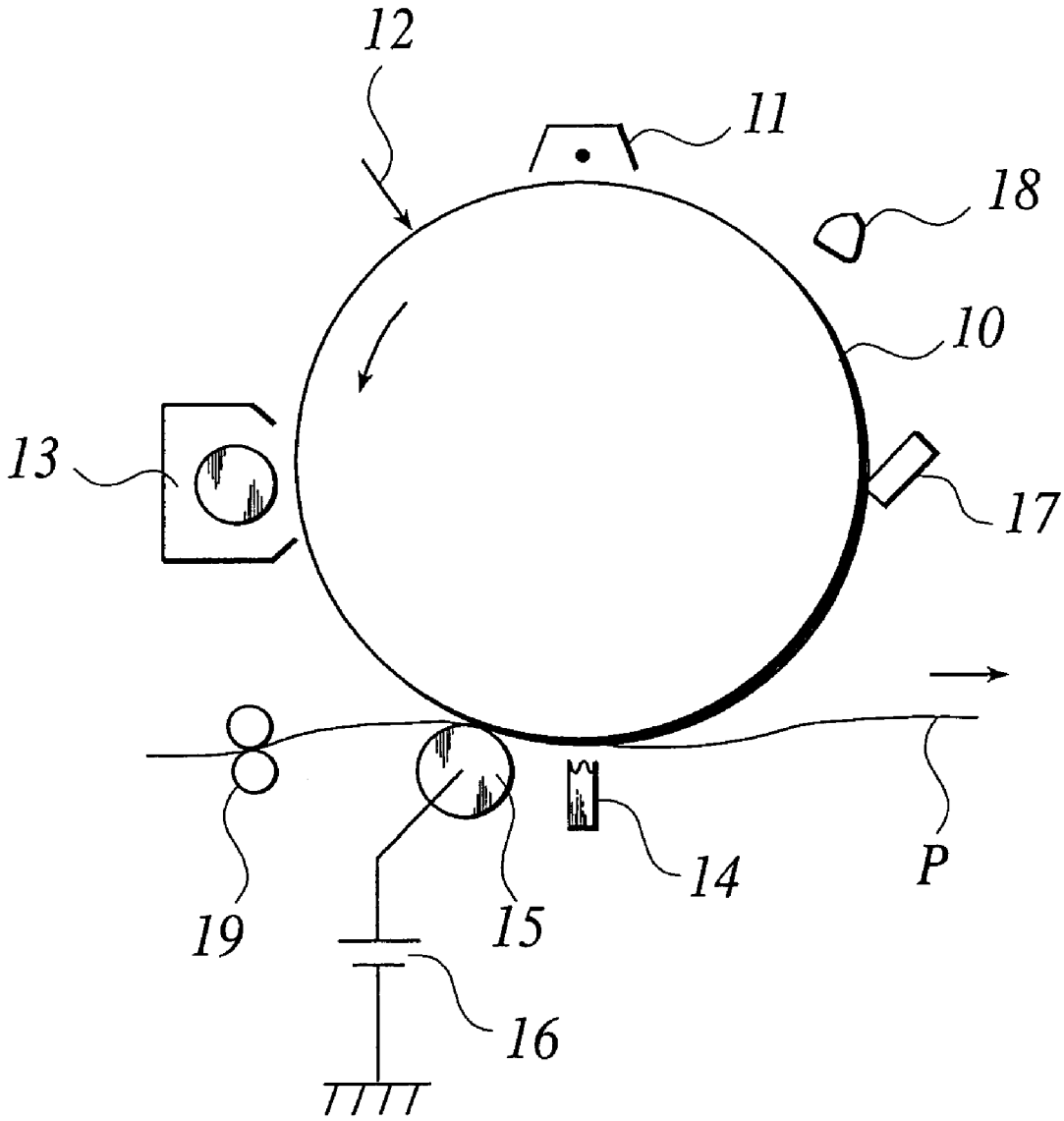
FIG. 6 is a schematic construction view showing one example of the image forming apparatus using the transferring roller.

FIG. 6 is a construction view schematically showing one example of an image forming apparatus employing a transferring roller. In FIG. 6, a photoreceptor 10 is an organic photoreceptor rotatable in the direction of the arrow, reference numeral 11 is a charging device for donating uniform charge on the surface of the photoreceptor, which maybe a corona discharger, a roller charging device or a magnetic brush charging device. Reference numeral 12 is light for digital image exposure from a semiconductor laser or a light emitting diode, by which an electrostatic latent image is formed on the photoreceptor. The electrostatic latent image is developed by a contact or non-contact developing method by a developing device 13 which stores a developer containing a toner with a volume average particle size of 3 μm to 9 μm, thus a toner image is formed on the photoreceptor. Incidentally, the exposure is particularly preferably digital image exposure in the present invention, however, analogue image exposure may be carried out.

As computers which are employed in the image forming method and apparatus thereof, or an scanning optical system which carries out light modulation based on digital image signals from copying original documents, included are a device in which an acoustic optical modulator is provided via an laser optical system and light modulation is carried out employing the acoustic optical modulator, as well as a device in which a semiconductor laser is employed and laser intensity is subjected to direct modulation. Spot exposure is carried out onto a uniformly charged photoreceptor from the scanning optical system, whereby dot images are formed.

A beam irradiated from the above-described scanning optical system results in a circular or elliptical luminance distribution approximating the normal distribution having a wide range at both sides. For example, a laser beam in either the primary scanning direction or the secondary scanning direction, or in both directions on the photoreceptor, generally results in extremely narrow circles or ellipses of 20 μm to 100 μm.

Thus formed toner image is transferred to a transfer material P which is synchronously transported, by a transferring roller 15 pressed to the photoreceptor with a pressure of 2.5 kPa to 100 kPa, preferably 10 kPa to 80 kPa, while applying a direct current bias potential.

A power source 16 of the direct current bias potential to the transferring roller 15 is preferably a constant current power source or a constant voltage power source. The current of the constant current power source is from 5 μA to 15 μA and the voltage of the constant voltage power source is from 400 V to 1500 V in the absolute value. The transfer material P on which the image is transferred by the transferring roller 15 is separated from the photoreceptor 10 by a separating electrode 14 and transported to a fixing device for heat-fixing, the fixing device is not shown in the figure.

The surface of the photoreceptor after the image transfer is cleaned by a cleaning blade 17 and discharged by a discharging lamp (PCL) 18 for the next image formation. Reference numerals 19 and 20 are each a paper feeding roller and a fixing device, respectively.

(Intermediate Transferring Body)

In the present invention, the toner image can also be transferred from the photoreceptor to the transfer material by a method employing an intermediate transferring body. Specifically, preferably employed is a method that respective image forming portions (image forming units) are provided for respective developers of four colors, visible images for each color are formed on each photoreceptor in each image forming portion, and these visible images are sequentially transferred to the intermediate transferring body and collectively transferred to the transfer material (Standard paper is commonly used, however, there is no limitation on the material as long as it is usable for transfer. In the present invention, an OHP sheet is particularly preferable as the transfer material.), followed by being fixed to obtain a color image.

Figure 7:
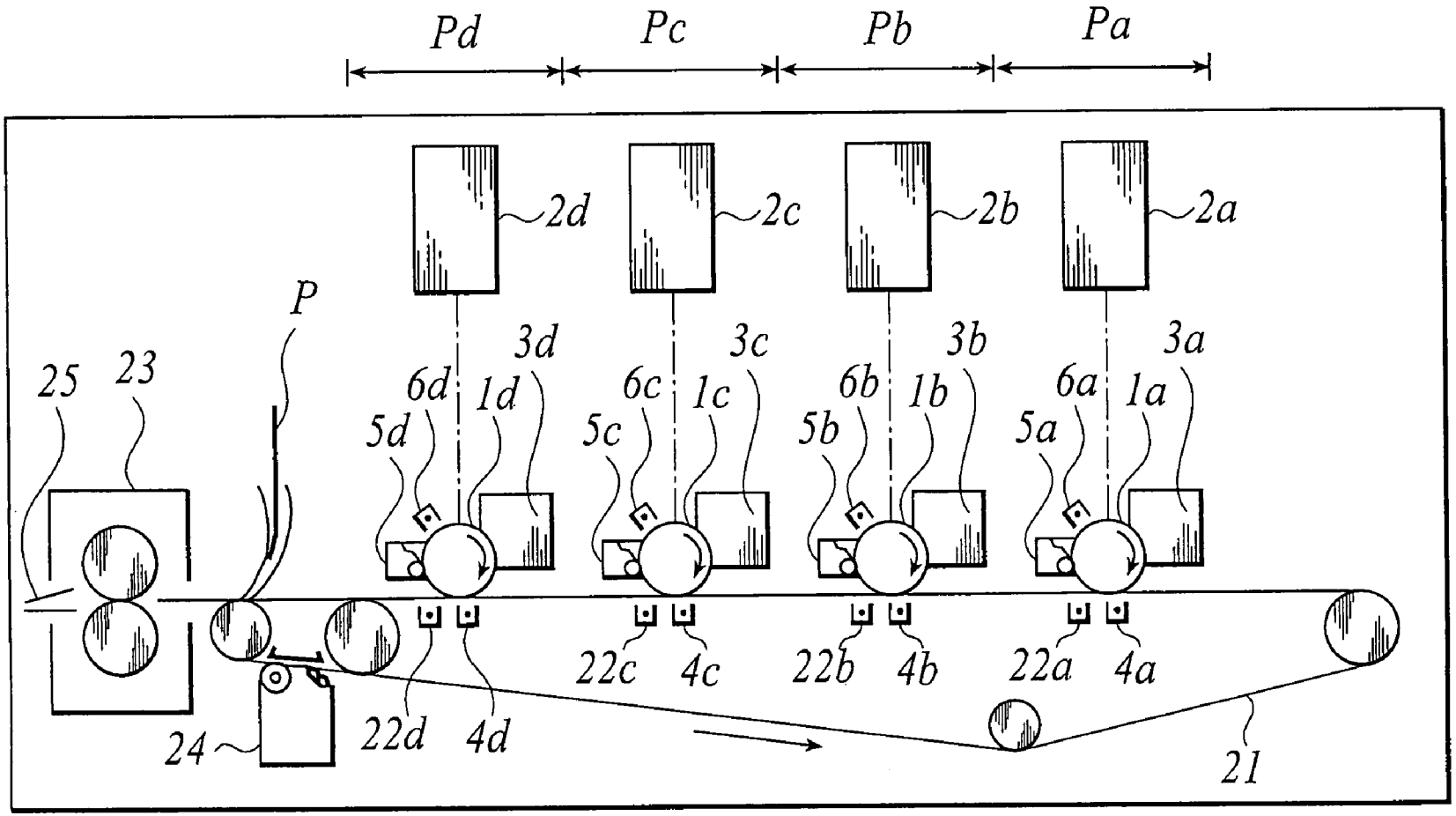
FIG. 7 is a schematic construction view showing one example of the image forming apparatus using the transfer belt.

An image forming method that the images with a plurality of colors employed in the image forming apparatus of the present invention are formed at the image forming portion and the formed images are sequentially stacked and transferred on the same intermediate transferring body is described by referring to the figures. FIG. 7 is a construction view schematically showing one example of the image forming apparatus employing the intermediate transferring body (transfer belt).

In FIG. 7, an image forming apparatus for obtaining a color image comprises a plurality of image forming units, in which respective visible images (toner images) with different colors are formed in respective image forming units, and the formed toner images are sequentially stacked and transferred on the same intermediate transferring body.

Herein, the first, second, third and fourth image forming units Pa, Pb, Pc and Pd are provided side by side and the image forming units comprise the photoreceptors 1*a*, 1*b*, 1*c* and 1*d*, respectively, as an electrostatic latent image forming body. These photoreceptors 1*a*, 1*b*, 1*c* and 1*d* have such a construction that latent image forming portions 2*a*, 2*b*, 2*c* and 2*d*, developing portions 3*a*, 3*b*, 3*c* and 3*d*, transferring discharging portions 4*a*, 4*b*, 4*c* and 4*d*, cleaning devices 5*a*, 5*b*, 5*c* and 5*d* having cleaning members and rubber blades, and charging devices 6*a*, 6*b*, 6*c* and 6*d* are disposed around the outer periphery of the photoreceptors.

In such a construction, first, a latent image of, for example, a yellow component in the original image is formed on the photoreceptor 1*a* of the first image forming unit Pa by use of the latent image forming portion 2*a*. The latent image is made to a visible image by use of a developer containing a yellow toner in the developing portion 3*a* and transferred to a transfer belt 21 at the transferring discharging portion 4*a*.

On the other hand, while the yellow toner image is transferred to the transfer belt 21 as described above, a latent image of a magenta component is formed on the photoreceptor 1*b* of the second image forming unit Pb, and sequentially made to a visible image by use of a developer containing a magenta toner in the developing portion 3*b*. When the transfer belt having transferred thereon the latent image in the above-described first image forming unit Pa is carried in the transferring discharging portion 4*b*, the visible image (magenta toner image) is stacked and transferred on a predetermined position of the transfer belt 21.

Subsequently, in the same manner as in the above-described method, latent images of the cyan component and the black component are formed in the third and fourth image forming units Pc and Pd, and the cyan toner image and the black toner image are stacked and transferred on the same transfer belt as described above. At the time of completion of such an image forming process, a superposed multi-color image is obtained on the transfer belt 21. After transfer, residual toner on the photoreceptors 1*a*, 1*b*, 1*c*, and 1*d* is removed by cleaning units 5*a*, 5*b*, 5*c*, and 5*d*, so that the photoreceptors are subjected to the subsequent latent image formation.

In the image forming apparatus, the transfer belt 21 is employed. In FIG. 7, the transfer belt 21 is conveyed from the right side to the left side. In the conveying process, the transfer images of each color are transferred when the belt is passed through respective transferring discharging portions 4*a*, 4*b*, 4*c* and 4*d* in respective image forming units Pa, Pb, Pc and Pd.

When the transfer belt 21 is passed through the fourth image forming unit Pd, AC voltage is applied to a separation charge eliminating discharger 22*d* to eliminate the charge on the transfer belt 21, and the toner images are collectively transferred on the transfer material P. Thereafter, the transfer material P is carried in the fixing apparatus 23 to fix the toner images and then, discharged from the discharge port 25, whereby a color image can be obtained.

Reference numerals 22*a*, 22*b*, 22*c* and 22*d* in the figure are the separation charge eliminating dischargers. After the completion of the toner image transfer, the transfer belt 21 is cleaned to remove residual toner by a cleaning device 24 with a combination of a brush-shaped cleaning member and a rubber blade, whereby the transfer belt is ready for the subsequent image formation.

Incidentally, as described above, there may be taken a construction that the lengthy transfer belt 21 like a conveying belt is used, superposed multi-color images are formed thereon and collectively transferred to the transfer material, or a construction that each independent transfer belt is provided in the respective image forming units and then the images are sequentially transferred from the respective transfer belts to the transfer material.

Employed as the transfer belt are endless films in which a 5 μm to 15 μm thick releasing agent layer prepared by adding an electrically conductive agent to a fluorine resin or a silicone resin so as to have a surface resistance of $10^5$ to $10^8$ Ω is provided on a high resistant film having a surface resistance of $10^{14}$Ω or more and a thickness of about 20 μm, such as polyimide, polyether, polyamide or tetrafluoroethylene-perfluorovinyl ether copolymer.

In the image forming method of the present invention, the toner image formed in the developing process is fixed in the fixing process via a process for transferring the image on the transfer material as described above. As suitable fixing methods employed in the present invention, it is possible to list so-called contact heating systems. In particular, as the contact heating systems, it is possible to list a heat pressure fixing system, a heating roll fixing system, and a pressure contact heat fixing system in which fixing is carried out employing a rotating pressure applying member including a heating body fixedly arranged.

The heat roller fixing system is constituted employing an upper roller prepared in such a manner that a cylindrical metal roller composed of iron, aluminum, etc., having a heating source in the interior is covered with tetrafluoroethylene, polytetrafluoroethylene-perfluoroalkoxyvinyl ether copolymers, etc., and a lower roller composed of silicone rubber, etc. The representative example of the heating source is one which comprises a line-shaped heater and heats the surface of the upper roller in the temperature range of about from 120° C. to 200° C. In the fixing section, pressure is applied between the upper roller and the lower roller so that the lower roller is deformed to form a so-called nip. The width of the nip is generally from 1 mm to 10 mm, and is preferably from 1.5 mm to 7 mm. The linear speed of fixing is preferably from 40 mm/second to 600 mm/second.

The above-described fixing system may be provided with a fixing-cleaning mechanism. Employed as the cleaning systems are those in which silicone oil is fed to an upper roller or a film for fixing, and cleaning is carried out employing a pad, a roller, a web, etc. in which silicone oil is impregnated.

Further, the image forming apparatus for use in the present invention may comprise a toner recycling mechanism recycling the non-transferred toner remaining on the surface of the photoreceptor. A method to recycle toner is not particularly limited. For example, cited may be a method in which toner recovered in a cleaning unit is conveyed employing a conveyer or a conveying screw to a supplying toner hopper or a development unit, mixed with freshly supplied toner in an intermediate chamber and supplied to the development unit. Preferably listed may be methods in which the recovered toner is directly returned to the development unit, or freshly supplied toner and recycled toner are mixed in an intermediate chamber and the resulting mixture is supplied.

Figure 8:
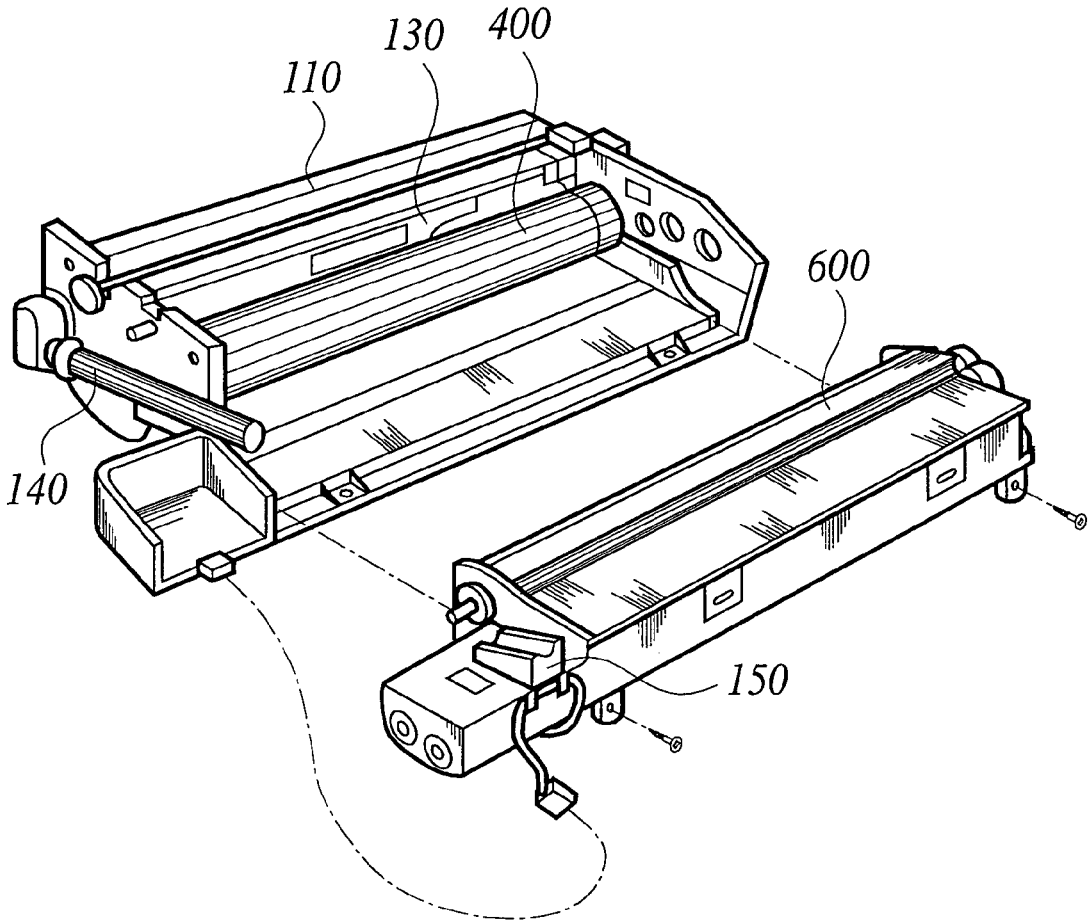
FIG. 8 is a perspective construction view of a toner recycling member.

Next, in FIG. 8, one example of a perspective construction view of a toner recycling member is shown. This method is one in which recycled toner is directly returned to the development unit.

Non-transferred toner, recovered by a cleaning blade 130, is collected and stored in toner recycling pipe 140, employing a conveying screw within a toner cleaning unit 110, and further is returned to a development unit 600 from a faucet 150 of the recycling pipe, and is repeatedly employed as a developer.

FIG. 8 is also a perspective view of a removable process cartridge attached to the image forming apparatus of the present invention. In FIG. 8, in order to make the perspective structure more understandable, the photoreceptor unit and the developer unit are drawn separately. However, these are integrated into one removable unit, which may be attached to the image forming apparatus. In this case, a photoreceptor, a development unit, a cleaning unit, and a recycling member are integrated into one unit to construct a process cartridge.

EXAMPLES

The present invention is described below by referring to the Examples, however, the present invention is not limited thereto. The term "part(s)" denotes "part (s) by mass".

Example 1

<<Production of Binder resin particle for Toner>>

[Preparation of Latex 1HML]

(1) Preparation of Core Particle (a First Stage Polymerization): Preparation of Latex (1H)

A surfactant solution (aqueous medium) prepared by dissolving 7.08 g of the anionic surfactant (compound (101) $C_{10}H_{21}(OCH_2CH_2)_2OSO_3Na$) in 3,010 g of ion-exchange water was charged into a 5,000 ml separable flask fitted with a stirring apparatus, a temperature sensor, a cooling pipe, and a nitrogen gas inlet unit, and the interior temperature was raised to 80° C. under a nitrogen gas flow while stirring at 230 rpm.

Subsequently, an initiator solution prepared by dissolving 9.2 g of a polymerization initiator (potassium persulfate: KPS) in 200 g of ion-exchange water was added to the surfactant solution, it was heated at 75° C. and then, a monomer mixture solution composed of 70.1 g of styrene, 19.9 g of n-butyl acrylate, and 10.9 g of methacrylic acid was added dropwise over 1 hour. Polymerization was conducted by stirring with heating at 75° C. for 2 hours (a first stage polymerization). Thus latex (a dispersion liquid of binder resin particle composed of high molecular weight binder resins) was prepared. The resulting latex was designated as "Latex (1H)".

(2) Formation of Intermediate Layer (a Second Stage Polymerization): Preparation of Latex (1HM)

A monomer solution was prepared in such a manner that 98.0 g of the Compound represented by 19) above (hereinafter referred to as "Exemplified Compound (19)") as a crystalline material was added to a monomer mixture solution composed of 105.6 g of styrene, 30.0 g of n-butyl acrylate, 6.2 g of methacrylic acid and 5.6 g of n-octyl-3-mercaptopropionic acid ester, and the mixture was heated to 90° C. to dissolve the monomers in a flask equipped with a stirrer.

On the other hand, a surfactant solution prepared by dissolving 1.6 g of an anionic surfactant (compound (101)) in 2,700 ml of ion-exchange water was heated to 98° C. To the surfactant solution, 28 g (in terms of solid content) of the latex (1H) as a dispersion liquid of core particles was added, then the monomer solution containing the Exemplified Compound 19) was mixed and dispersed by means of a mechanical dispersion machine, "CLEARMIX" (produced by M Technique Ltd.) equipped with circulating pass for 8 hours, and a dispersion liquid (emulsion) containing emulsified particles (oil droplet) having a dispersion particle size (284 nm) was prepared.

Subsequently, an initiator solution prepared by dissolving 5.1 g of polymerization initiator (KPS) in 240 ml of ion-exchange water, and 750 ml of ion-exchange water were added to the dispersion liquid (emulsion). Polymerization (a second stage polymerization) was conducted by stirring this system with heating at 98° C. over 12 hours, as a result, latex (a dispersion liquid of composite binder resin particles having a structure that the surface of binder resin particles composed of high molecular weight binder resin is covered with an middle molecular weight binder resin) was obtained. The resulting latex was designated as "Latex (1HM)".

The latex (1HM) was dried and observed by a scanning electron microscope, as a result, particles (400 nm to 1000 nm) mainly composed of Exemplified Compound (19), which was not incorporated in the latex particles, was observed.

(3) Formation of Outer Layer (a Third Stage Polymerization): Preparation of Latex (1HML)

An initiator solution prepared by dissolving 7.4 g of a polymerization initiator (KPS) in 200 ml of ion-exchange water was added to the latex (1HM) obtained as described above, then a monomer mixture solution composed of 300 g of styrene, 95 g of n-butylacrylate, 15.3 g of methacrylic acid, and 10.4 g of n-octyl-3-mercaptopropionic acid ester was added dropwise over 1 hour at temperature of 80° C. After the completion of dropping the solution, polymerization (the third stage polymerization) was conducted by stirring with heating over 2 hours, and then the mixture solution was cooled to 28° C. Thus latex (a dispersion liquid of composite binder resin particle having a core part composed of a high molecular weight binder resin, an inter layer composed of an middle molecular weight binder resin and an outer layer composed of a low molecular weight binder resin, in which the Exemplified Compound (19) was incorporated in the inter layer) was obtained. The resulting latex was designated as "Latex (1HML)".

Composite binder resin particles constructing the latex (1HML) have peaks at a molecular weight of 138,000, 80,000 and 13,000, and a weight average particle size of the composite binder resin particles was 122 nm.

[Preparation of Latex (2 L)]

A polymerization initiator solution prepared by dissolving 14.8 g of a polymerization initiator (KPS) in 400 ml of ion-exchange water was charged into a flask fitted with a stirring apparatus, then monomer mixture solution composed of 600 g of styrene, 190 g of n-butylacrylate, 30.0 g of ethacrylic acid, and 20.8 g of n-octyl-3-mercaptopropionic acid ester was added dropwise over 1 hour at a temperature of 80° C. After the completion of dropping the solution, polymerization was conducted by stirring with heating over 2 hours, and then the mixture solution was cooled to 27° C. Thus latex (a dispersion liquid of binder resin particle composed of a low molecular weight binder resin) was obtained. The resulting latex was designated as "Latex (2 L)".

Binder resin particles constructing the latex (2 L) have a peak at a molecular weight of 11,000, and a weight average particle size of the binder resin particles was 128 nm.

<<Production of Colored Particles>>

[Production of Colored Particle 1]

(Dispersion of Colorant)

59.0 g of anionic surfactant (compound (101)) was added to 1600 ml of ion-exchange water and was stirred and dissolved. While stirring the resulting solution, 420.0 g of Compound 1 (PTMA lake) as a colorant was gradually added, and subsequently dispersed employing a stirring apparatus, "CLEARMIX" (manufactured by M Technique Ltd.). Thus a dispersion liquid of colorant particles (hereinafter referred to as "Colorant Dispersion Liquid 1") was prepared. A weight average particle size of the colorant particles in the Colorant Dispersion Liquid 1 was measured by employing an electrophoresis light scattering photometer "ELS-800" (manufactured by Ohtsuka Denshi Co.), and it was found to be 110 nm.

(Aggregation/Fusion)

420.7 g (in terms of solid content) of Latex (1HML), 900 g of ion-exchange water, and 200 g of "Colorant Dispersion Liquid 1" were charged into a reaction vessel (a four-necked flask) fitted with a temperature sensor, a cooling pipe, a nitrogen gas inlet unit, and a stirring apparatus, and the resulting mixture was stirred. After adjusting the vessel interior temperature to 30° C., 5 mol/L of an aqueous sodium hydroxide solution was added to the resulting solution, and the pH was adjusted to from 8 to 11.0.

Subsequently, an aqueous solution prepared by dissolving 12.1 g of magnesium chloride hexahydrate in 1,000 ml of ion-exchange water was added under stirring at 30° C. over 10 minutes. After setting the resulting mixture aside for 3 minutes, it was heated so that the temperature was elevated to 90° C. over 60 minutes. While maintaining the resulting state, the size of coalesced particles was measured employing a "Coulter Counter TA-II". When the number average particle size reached 4 μm to 7 μm, the growth of particles was terminated by the addition of an aqueous solution prepared by dissolving 40.2 g of sodium chloride in 1,000 ml of ion-exchange water, and further fusion was continuously carried out at a liquid temperature of 98° C. over 6 hours, while performing heating with stirring as a ripening process.

Further, 96 g of Latex (2 L) (a dispersion liquid of binder resin particles) was added and continuously heated with stirring over 3 hours to fuse Latex (2 L) on the aggregate particle surface of Latex (1HML). At this moment, 40.2 g of sodium chloride was added to the mixture solution, the temperature was cooled to 30° C. at a rate of 8° C./minute. Thereafter, hydrochloric acid was added to the resulting solution, the pH was adjusted to 2.0, and then stirring was terminated. The resulting salted-out, aggregated and fused particles were collected through filtration, and repeatedly washed with ion-exchange water at 45° C. Washed particles were then dried by air at 40° C., and the colored particles 1 of the present invention were obtained.

A dispersion state of colorant was controlled by the control of a pH during aggregation process, an addition timing of Latex (2 L) and a stirring strength, and further a particle size and a variation coefficient of particle size distribution were arbitrarily adjusted by classification in a liquid.

<<Preparation of Toner>>

Into the above-described colored particle 1, 1% by mass of hydrophobic silica (a number average primary particle size: 12 nm, a degree of hydrophobicity: 68) and 0.3% by mass of hydrophobic titanium oxide (a number average primary particle size: 20 nm, a degree of hydrophobicity: 63) were added and mixed by use of a Henschel mixer. Thus, the electrostatic image developing toner 1 was obtained.

<<Measurement and Calculation of Physical Properties>>

In the same manner as in the measuring method of the weight average particle size and the distribution of the colorant in the toner particle and the area of Voronoi polygons, a cross section of the toner was photographed by a transmission electron microscope (TEM) and then, the image information photographed by the use of an image processing apparatus "Lusex F" (manufactured by Nicole Co., Ltd.) was processed. Thus the measurement and the calculation of the physical property data as described in Table 1 and Table 2 were carried out.

<<Preparation of Developer>>

The electrostatic image developing toner 1 obtained as above was blended with a silicon binder resin coated-ferrite carrier having a volume average particle size of 60 μm so as to result in a toner concentration of 6%. Thus the developer was prepared. The resulting developer was designated as developer 1.

<<Conditions of Image Forming Apparatus Used for Evaluation of Developers 1 to 4, 6 and 7>>

Hereinafter, the conditions of an image forming apparatus used for the evaluation of the developers 1 to 4, 6 and 7 will be explained.

Figure 10:
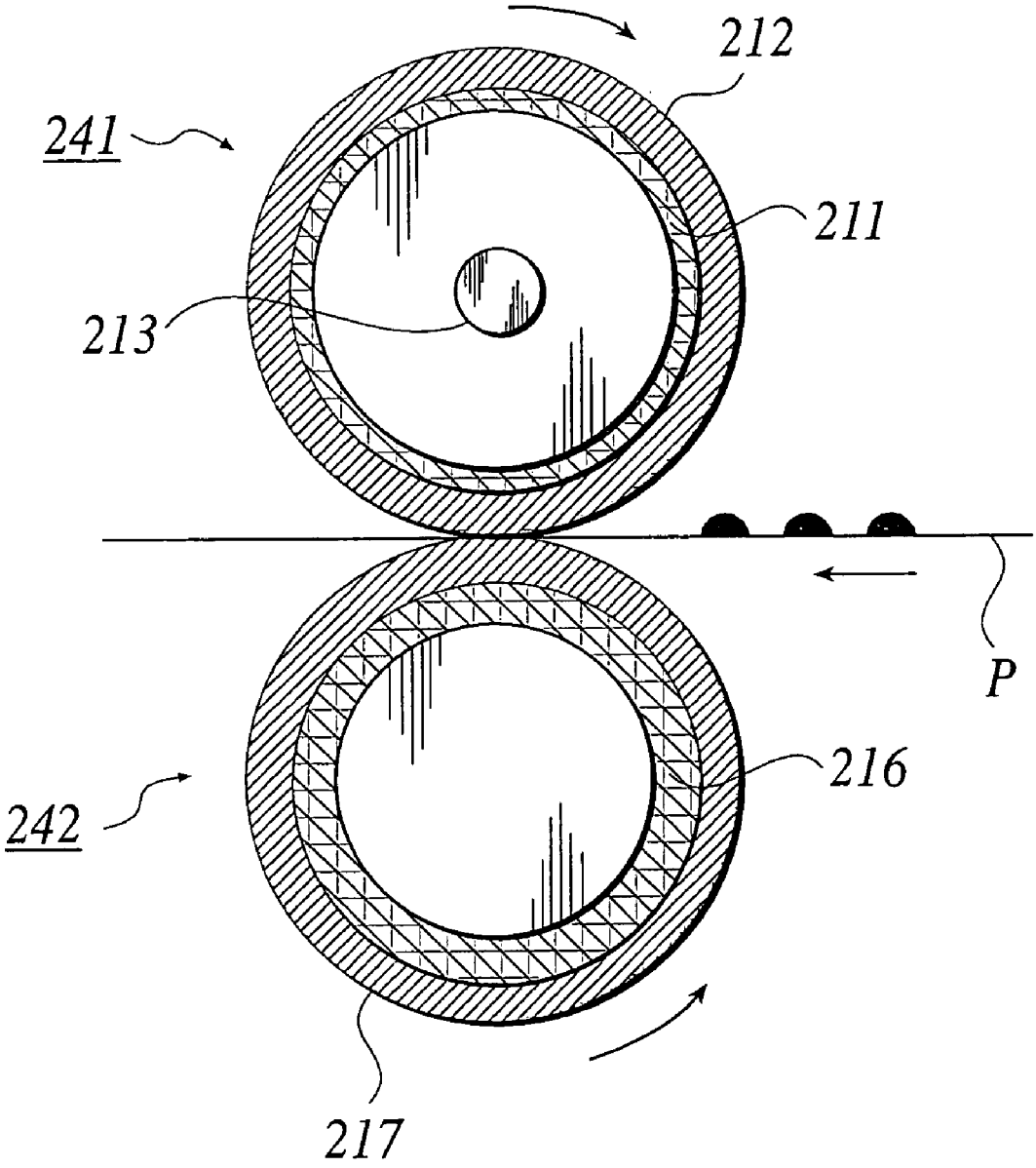
FIG. 10 is a schematic cross-sectional view showing one example of the pressure contact heat-fixing device.

Using the developer 2, an actual photographing test was carried out by the use of a digital color copier having the same construction as in the image forming apparatus shown in FIG. 7, and a pressure contact heat-fixing device as shown in FIG. 10 as the fixing device.

A specific construction of the fixing device was set as follows.

The fixing unit comprises a heating roller (an upper roller) 241 prepared by covering the surface of a cylindrical core bar (having an interior diameter of 40 mm, a wall thickness of 1.0 mm, and a total width of 310 mm) 211, housing a heater 213 at the central section, with silicone rubber (thickness: 120 μm) 212 of PFA (tetrafluoroethylene-perfluoroalkylvinylether copolymer), and a pressure roller (a lower roller) 242 prepared by covering the surface of the core bar (having an interior diameter of 40 mm and a wall thickness of 2.0 mm) 216 with a sponge-like silicone rubber (having an Asker C hardness of 48 degrees and a thickness of 2 mm) 217. The nip width used herein was 5.8 mm. Employing the fixing device, a linear speed for printing was set at 250 mm/second.

Further, employed as a cleaning mechanism of the fixing device was a supply method of a web system in which polydiphenylsilicone (having a viscosity of 10 Pa·s at 20° C.) was impregnated.

Fixing temperature was controlled by the surface temperature of the upper roller and set at 180° C.

<<Evaluation Method of Developer>>

Hereinafter, the evaluation method of the developer 2 will be explained.

[Chromaticity Evaluation]

The evaluation of chromaticity of the toner was performed according to the measurement of chroma C*. The measurement was carried out by placing white paper on the back, using Minolta CR 3000 provided with a light source D 65.

The chroma C* can be calculated from L*a*b*color space mapping specified by JIS Z 8729, using the following formula (a).

$$\text{Chroma } C^* = [(a^*)^2 + (b^*)^2]^{1/2} \qquad \text{formula (c)}$$

wherein a* and b* each represents a value of a* coordinate or b* coordinate, and L* represents a coordinate of lightness.

Evaluation was performed based on the ranking as described below, employing a value of the chroma C* calculated from the formula (c) above.

o: C* is 60 or more (practicable)

x: C* is less than 60 (not meet the market needs)

[Heat Resistance Evaluation]

Evaluation of heat resistance is performed by measuring color changes in a top side and a bottom side at the printing of both sides. Using a magenta developer, an image with a square (5 cm×5 cm) was formed on a photoreceptor by use of a toner. The image was subjected to evaluation of heat resistance by the following method.

The change of color was evaluated in accordance with a margin of fluctuation before and after the fixing of b*. When the margin of fluctuation is large, a desired color is not obtained, as a result, slippage occurs in the color matching. The margin of fluctuation must be practically less than 2.0, preferably less than 1.0.

◎: less than 1.0 o: less than 2.0 x: 2.0 or more

[Generation Conditions of Fog]

5,000 sheets of magenta images were continuously printed under the environment of a high temperature and a high humidity (temperature: 33° C., relative humidity: 80%) and then the apparatus was set aside for 72 hours while leaving the power source off. Thereafter, the printing was performed again and the formed images were sequentially observed. The number of image stain (fog) was counted with an eye. When the number of the stain was from 0 to less than 10, this case was judged to be good.

◎: 0 to 3 o: 4 to less than 10 x: 10 or more

[Transmittance Evaluation of OHP Image]

As to transmittance of an OHP image, a transmitted image (OHP image) was prepared and evaluated by a method described below. Toner deposit was evaluated in the range of 0.7±0.05 (mg/cm$^2$). Using "330 type self-recording spectrophotometer" manufactured by Hitachi, Ltd, a fixed image was measured on the visible spectral transmittance using, as a reference, an OHP sheet on which the toner was not supported. In a yellow toner, a difference of spectral transmittance between 650 nm and 550 nm was determined and the obtained value was used as a scale of the transmittance of OHP image. When the value is 60% or more, it can be judged that the image has good transmittance.

◎: 70% or more o: from 60% to less than 70% x: less than 60%

[Odor Evaluation]

With respect to the presence or absence of odor, sensory evaluation was performed. With respect to the presence or absence of odor, evaluation was performed by 10 panelists randomly collected, in which the number of panelists who felt odor was counted. When less than 3 panelists felt odor, it was judged that odor was not substantially present.

Example 2

The colored particle 2 of the present invention was obtained in the same manner as the Example 1 except for using Compound 2 (PTMA lake) in place of Compound 1 (PTMA lake) as a colorant, controlling the dispersion state (a dispersed particle size, an average particle size of colorants in a medium, etc.) of colorants as described in Table 1 and Table 2 by the control of a pH during aggregation process, an addition timing of Latex (2 L) and a stirring strength, and further arbitrarily adjusting a particle size and a variation coefficient of particle size distribution by classification in a liquid.

The toner 2 for developing an electrostatic image was obtained by preparing toner by using the colored particle 2 in the same producing method as the Example 1. The developer 2 was obtained by preparing two-component developer in the same as the Example 1.

The evaluation of the developer 2 was carried out under the conditions of an image forming apparatus used for the evaluation of the developer and by the evaluation method of the toner, which were the same as the Example 1.

Example 3

The colored particle 3 of the present invention was obtained in the same manner as the Example 1 except for using Compound 3 in place of Compound 2 (PTMA lake) as a colorant, controlling the dispersion state of colorants as described in Table 1 and Table 2 by the control of a pH during aggregation process, an addition timing of Latex (2 L) and a stirring strength, and further arbitrarily adjusting a particle size and a variation coefficient of particle size distribution by classification in a liquid.

The toner 3 for developing an electrostatic image was obtained by preparing toner by using the colored particle 3 in the same producing method as the Example 1. The developer 3 was obtained by preparing two-component developer in the same as the Example 1.

The evaluation of the developer 3 was carried out under the conditions of an image forming apparatus used for the evaluation of the developer and the evaluation method of the toner, which were the same as the Example 1.

Example 4

The colored particle 4 of the present invention was obtained in the same manner as the Example 1 except for using a mixture of Compound 1 (PTMA lake) and Pigment Red 48:3 at a ratio of 50:50 (a ratio of % by mass) as the colorant as described in Table 1, controlling the dispersion state of colorants as described in Table 1 and Table 2 by the control of a pH during aggregation process, an addition timing of Latex (2 L) and a stirring strength, and further arbitrarily adjusting a particle size and a variation coefficient of particle size distribution by classification in a liquid.

Further, the toner 4 for developing an electrostatic image was obtained by preparing toner by using the colored particle 4 in the same producing method as the Example 1. The measurement and the calculation of the physical property data as described in Table 1 and Table 2 were carried out by TEM in the same method as the Example 1.

The developer 4 was obtained by preparing two-component developer using the toner 4 for developing an electrostatic image, in the same as the production of the Example 1.

The evaluation of the developer 4 was carried out under the conditions of an image forming apparatus used for the evaluation of the developer and the evaluation method of the toner, which were the same as the Example 1.

Example 5

The colored particle 5 of the present invention was obtained in the same manner as the Example 4 except for using a mixture of Compound 1 (PTMA lake) and Pigment Red 48:1 at a ratio of 50:50 (a ratio of % by mass) as the colorant as described in Table 1, controlling the dispersion state of colorants as described in Table 1 and Table 2 by the control of a pH during aggregation process, an addition timing of Latex (2 L) and a stirring strength, and further arbitrarily adjusting a particle size and a variation coefficient of particle size distribution by classification in a liquid.

Further, the toner 5 for developing an electrostatic image was obtained by preparing toner by using the colored particle 5 in the same producing method as the Example 1. The measurement and the calculation of the physical property data as described in Table 1 and Table 2 were carried out by TEM in the same method as the Example 1.

The toner 5 for developing an electrostatic image was treated as non-magnetic one-component developer and the developer 5.

<<Conditions of Image Forming Apparatus Used for Evaluation of Developers 5 and 8>>

Hereinafter, the conditions of an image forming apparatus used for the evaluation of the developers 5 and 8 will be explained.

Figure 9:
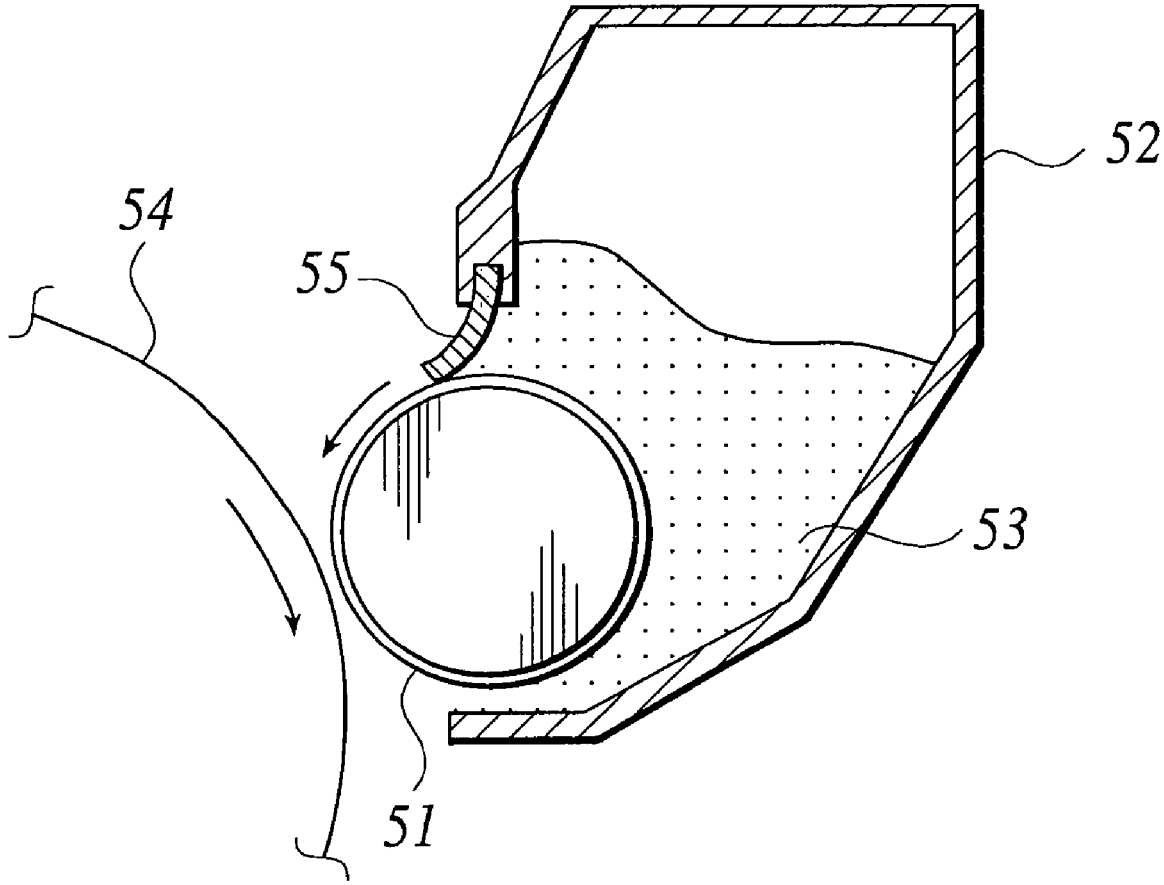
FIG. 9 is a schematic cross-sectional view of the developing device.

Using the developer 5 and the developer 8 in Comparative Example, an actual photographing test was carried out, in which 100,000 sheets of full color images (each pixel ratio of Y/M/C/Bk was 15%) were continuously formed under an environment of a high temperature and a high humidity (temperature: 33° C., relative humidity: 80%), using the color image forming apparatus shown in FIG. 7 equipped with the developing device shown in FIG. 9.

Further, as a fixing device of the color image forming apparatus, used was a pressure contact heat-fixing device as shown in FIG. 10. A specific construction of the fixing device was set as follows. A heating roller 241 (an upper roller) was constructed by covering the surface of an aluminum alloy cylindrical (having an interior diameter of 30 mm, a wall thickness of 1.0 mm, and a total width of 310 mm) core bar 211, housing a heater 213 at the central section, with silicone rubber (having an Asker C hardness of 30 degrees and a thickness of 2 mm) 212. On the other hand, a pressure roller 242 (a lower roller) was constructed by covering the surface of iron cylindrical (having an interior diameter of 40 mm and a wall thickness of 2.0 mm) core bar 216 with sponge-like silicone rubber (having an Asker C hardness of 30 degrees and a thickness of 8 mm) 217. The heating roller was brought into contact with the pressure roller under an application of total load of 150 N to form a nip having a width of 5.8 mm. Employing this fixing unit, a linear speed for printing was set at 180 mm/second. A surface of the heating roller was covered with tube (50 μm)

of PFA. Further, employed as a cleaning mechanism of the fixing device was a supply method of a web system in which dimethylsilicone (having a viscosity of 10 Pa·s at 20° C.) was impregnated. Fixing temperature was controlled by the surface temperature of the heating roller (the setting temperature: 175° C.). Further, the coated amount of the silicone oil was adjusted to 0.1 mg/A4 sized sheet.

The evaluation of the developer 5 was carried out by the evaluation method of the toner, which was the same as the Example 1.

Comparative Example 1

The colored particle 6 of the Comparative Example 1 was obtained in the same manner as the Example 1 except for using C.I. Pigment Red 48:1 described in Table 1 in place of Compound 1 (PTMA lake), controlling the dispersion state of colorants as described in Table 1 and Table 2 by the control of a pH during aggregation process, an addition timing of Latex (2 L) and a stirring strength, and further arbitrarily adjusting a particle size and a variation coefficient of particle size distribution by classification in a liquid.

Further, the toner 6 for developing an electrostatic image was obtained by preparing toner by using the colored particle 6 in the same producing method as the Example 1. The measurement and the calculation of the physical property data as described in Table 1 and Table 2 were carried out by TEM in the same method as the Example 1.

The developer 6 of the comparative example was obtained by preparing two-component developer using the toner 6 for developing an electrostatic image, in the same as the production of the Example 1.

The evaluation of the developer 6 of the comparative example 1 was carried out under the conditions of an image forming apparatus used for the evaluation of the developer and the evaluation method of the toner, which were the same as the Example 1.

Comparative Example 2

The colored particle 7 of the Comparative Example 2 was obtained in the same manner as the Example 1 except for using C.I. Pigment Red 48:1 described in Table 1 in place of Compound 1 (PTMA lake), controlling the dispersion state of colorants by the control of a pH during aggregation process, an addition timing of Latex (2 L) and a stirring strength, and further arbitrarily adjusting a particle size and a variation coefficient of particle size distribution by classification in a liquid.

Further, the toner 7 for developing an electrostatic image was obtained by preparing toner by using the colored particle 7 in the same producing method as the Example 1. The measurement and the calculation of the physical property data as described in Table 1 and Table 2 were carried out by TEM in the same method as the Example 1.

The developer 7 of the comparative example was obtained by preparing two-component developer using the toner 7 for developing an electrostatic image, in the same as the production of the Example 1.

The evaluation of the developer 7 of the comparative example 2 was carried out under the conditions of an image forming apparatus used for the evaluation of the developer and the evaluation method of the toner, which were the same as the Example 1.

Comparative Example 3

The colored particle 8 of the Comparative Example 3 was obtained in the same manner as the Example 1 except for using a mixture of Compound 1 (PTMA lake) and Pigment Red 48:1 at a ratio of 50:50 (a ratio of % by mass) as the colorant as described in Table 1, controlling the dispersion state of colorants as described in Table 1 and Table 2 by the control of a colorant dispersion time, a pH during aggregation process, an addition timing of Latex (2 L) and a stirring strength, and further arbitrarily adjusting a particle size and a variation coefficient of particle size distribution by classification in a liquid.

Further, the toner 8 for developing an electrostatic image was obtained by preparing toner by using the colored particle 8 in the same producing method as the Example 1. The measurement and the calculation of the physical property data as described in Table 1 and Table 2 were carried out by TEM in the same method as the Example 1.

The toner 8 for developing an electrostatic image was treated as non-magnetic one-component developer and the developer 8 of the comparative example.

The evaluation of the developer 8 of the comparative example 3 was carried out under the conditions of an image forming apparatus used for the evaluation of the developer and the evaluation method of the toner, which were the same as the Example 5.

In the preparation of the electrostatic image developing toners from colored particles, there is no physical variation between colored particles and electrostatic image developing toners correspondent thereto in physical properties such as shape, particle size, etc. (a shape, a particle size, a shape coefficient and a variation coefficient of shape coefficient, etc. are not changed).

The obtained toner's colorant components, colorant dispersion state, physical properties, physical properties of toner particle (the same as colorant particles) developer, etc. are shown in Table 1 and Table 2.

TABLE 1

| | COLORANT | | | | | | | |
|---|---|---|---|---|---|---|---|---|
| TONER No. | COMPOUND No. | SIMULTANEOUSLY USED COLORANT | MIXING RATIO OF COORALNT (% by mass) | WEIGHT AVERAGE PARTICLE SIZE IN AQUEOUS DISPERSION MEDIUM (nm) | FERET'S AVERAGE HORIZONTAL DIAMETER IN TONER PARTICLE (nm) | RATIO OF PARTICLES with FERET'S HORIZONTAL DIAMETER OF 2 TO 300 nm (% by number) | VARIATION COEFFICIENT OF FERET'S HORIZONTAL DIAMETER | REMARKS |
| 1 | 1 | — | — | 112 | 85 | 99 | 30 | Present Invention |
| 2 | 2 | — | — | 124 | 125 | 91 | 28 | Present Invention |
| 3 | 3 | — | — | 144 | 315 | 66 | 35 | Present Invention |

TABLE 1-continued

| TONER No. | COLORANT COM-POUND No. | SIMULTA-NEOUSLY USED COLORANT | MIXING RATIO OF COORALNT (% by mass) | WEIGHT AVERAGE PARTICLE SIZE IN AQUEOUS DISPERSION MEDIUM (nm) | FERET'S AVERAGE HORIZONTAL DIAMETER IN TONER PARTICLE (nm) | RATIO OF PARTICLES with FERET'S HORIZONTAL DIAMETER OF 2 TO 300 nm (% by number) | VARIATION COEFFICIENT OF FERET'S HORIZONTAL DIAMETER | REMARKS |
|---|---|---|---|---|---|---|---|---|
| 4 | 1 | (b)* | 50:50 | 213 | 385 | 62 | 37 | Present Invention |
| 5 | 1 | (a)* | 50:50 | 344 | 435 | 59 | 39 | Present Invention |
| 6 | (a)* | — | — | 320 | 480 | 51 | 42 | Comparative Example |
| 7 | (a)* | — | — | 410 | 665 | 12 | 43 | Comparative Example |
| 8 | 1 | (a)* | 50:50 | 385 | 610 | 5 | 45 | Comparative Example |

(a)*: C.I. Pigment Red 48:1
(b)*: C.I. Pigment Red 48:3

TABLE 2

| TON-ER No. | TONER PARTICLE SIZE (μm) | AREA OF VORONOI POLYGON AVER-AGE ($nm^2$) | VARIATION COEFFICIENT (%) | 160,000 $nm^2$ OR MORE (% by number | RATIO OF TONER PARTICLES HAVING NO CORNERS (%) | VARIATION COEFFICIENT IN NUMBER PARTICLE SIZE DISTRIBUTION (%) | RATIO OF TONER PARTICLES WITH SHAPE COEFFICIENT OF 1.01 TO 1.6 (%) | VARIATION COEFFICIENT OF SHAPE COEFFICIENT (%) | REMARKS |
|---|---|---|---|---|---|---|---|---|---|
| 1 | 5.5 | 67000 | 11.5 | 6.7 | 62 | 24.2 | 66.4 | 15.7 | Present Invention |
| 2 | 6.5 | 89500 | 10.3 | 7.6 | 53 | 26.4 | 65.2 | 15.1 | Present Invention |
| 3 | 7.0 | 92500 | 16.4 | 6.8 | 55 | 25.8 | 65.2 | 15.4 | Present Invention |
| 4 | 7.2 | 92700 | 19.7 | 7.1 | 51 | 22.4 | 67.1 | 15.1 | Present Invention |
| 5 | 7.6 | 93500 | 19.8 | 17.5 | 55 | 26.7 | 66.0 | 15.9 | Present Invention |
| 6 | 7.2 | 102000 | 20.1 | 19.5 | 51 | 27.4 | 62.3 | 15.7 | Comparative Example |
| 7 | 6.6 | 450000 | 31.2 | 80.0 | 53 | 29.3 | 60.1 | 18.0 | Comparative Example |
| 8 | 5.9 | 233000 | 29.3 | 54.0 | 55 | 30.1 | 57.5 | 17.9 | Comparative Example |

The results of the evaluations for the chromaticity, the heat resistance, the fog, the transmittance in OHP and the odor, of the Examples 1 to 5 and the Comparative Example 1 to 3, are shown in Table 3.

TABLE 3

| DEVELOPER No. | CHROMATICITY | HEAT RESISTANCE | FOG | TRANSMITTANCE IN OHP | ODOR EVALUATION | REMARKS |
|---|---|---|---|---|---|---|
| 1 | ○ | ◎ | ◎ | ◎ | NO ODOR | Present Invention |
| 2 | ○ | ◎ | ◎ | ◎ | NO ODOR | Present Invention |
| 3 | ○ | ◎ | ◎ | ○ | NO ODOR | Present Invention |
| 4 | ○ | ◎ | ◎ | ○ | NO ODOR | Present Invention |
| 5 | ○ | ○ | ○ | ◎ | NO ODOR | Present Invention |
| 6 | X | X | X | X | ODOR | Comparative Example |
| 7 | X | X | X | X | ODOR | Comparative Example |
| 8 | ○ | ○ | X | X | ODOR | Comparative Example |

As is apparent from Table 3, the samples of the present invention exhibit good chromaticity and have high heat resistance, low fog, good transmittance in OHP, and little odor; as compared with those of Comparative Examples.

According to the present invention, a toner for developing an electrostatic image, which exhibits good chromaticity and has high heat resistance, low fog, good transmittance in OHP, and no odor; a method for producing the toner; and an image forming method, can be provided.

The entire disclosure of Japanese Patent Application Publication No. 2001-370029 filed on Dec. 4, 2001, including specification, claims, drawings and summary are incorporated herein by reference in its entirety.

What is claimed is:

1. A toner for developing an electrostatic image, comprising toner particles containing a binder resin and a colorant, wherein a Feret's average horizontal diameter of the colorant is from 10 nm to 500 nm, a ratio of the colorant having the Feret's horizontal diameter of from 2 nm to 300 nm is 50% by number or more, and the colorant contains a compound represented by a following General Formula (1) or a lake of the compound:

General Formula (1)

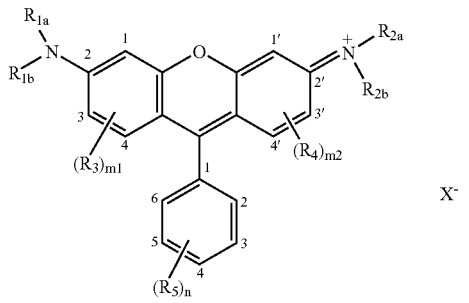

wherein Ria, Rib, R2a and R2b each represents a hydrogen atom, an alkyl group having from 1 to 5 carbon atoms or a fluoroalkyl group having from 1 to 5 carbon atoms, R3 and R4 each represents a hydrogen atom, an alkyl group having from 1 to 5 carbon atoms or a fluoroalkyl group having from 1 to 5 carbon atoms, R5 represents a hydrogen atom, an alkyl group having from 1 to 5 carbon atoms, a fluoroalkyl group having from 1 to 5 carbon atoms, an alkoxyl group having from 1 to 5 carbon atoms, a halogen atom, a cyano group, a nitro group, a sulfo group, an alkali earth metal salt or higher amine salt having a sulfo group, N-phenylaminosulfonyl group, a carboxyl group, an alkali earth metal salt or higher amine salt having a carboxyl group, N-phenylcarbamoyl group, an ureylene group, an iminodicarbonyl group, an alkoxycarbonyl group, —CONHR6 (wherein R6 represents a hydrogen atom, an alkyl group having from 1 to 8 carbon atoms or a phenyl group), —NHCOR7 (wherein R7 represents an alkyl group) or —SO2R8 (wherein Rs is an alkyl group having from 1 to 8 carbon atoms), m1 and m2 each represents an integer of 1 to 5, n represents a number of 1 to 5, and X~ represents an anion.

2. The toner of claim 1, wherein the toner particles are produced by adding the colorant dispersed so as to have a weight average particle size of 2 nm to 300 nm, to an aqueous dispersion medium.

3. The toner of claim 1, comprising the toner particles having a domain-matrix structure constructed by the binder resin and the colorant, wherein an average area of Voronoi polygons formed by a perpendicular bisecting line between centers of gravity of adjacent domains in the toner particle is from 20,000 $nm^2$ to 120,000 $nm^2$ and a variation coefficient of the area of the Voronoi polygons is 25% or less.

4. The toner of claim 1, comprising the toner particles having a domain-matrix structure constructed by the binder resin and the colorant, wherein an average area of Voronoi polygons formed by a perpendicular bisecting line between centers of gravity of adjacent domains in the toner particle is from 40,000 $nm^2$ to 100,000 $nm^2$ and a variation coefficient of the area of the Voronoi polygons is 20% or less.

5. The toner of claim 4, wherein the Feret's average horizontal diameter of the colorant is from 50 nm to 300 nm, a ratio of the colorant having the Feret's horizontal diameter of from 2 nm to 300 nm is 60% by number or more and a variation coefficient of the Feret's horizontal diameter of the colorant is 40% or less.

6. The toner of claim 1 comprising the toner particles having a domain-matrix structure constructed by the binder resin and the colorant, wherein an average area of Voronoi polygons formed by a perpendicular bisecting line between centers of gravity of adjacent domains in the toner particle is from 20,000 $nm^2$ to 120,000 $nm^2$ and a ratio of a domain forming a Voronoi polygon having an area of 160,000 $nm^2$ or more is from 3% by number to 20% by number in all the domains.

7. The toner of claim 1, wherein a ratio of toner particles having no corners in all of toner particles is 50% by number or more and a number variation coefficient in a number particle size distribution is 27% or less.

8. The toner of claim 1, wherein a ratio of toner particles having a shape coefficient of from 1.01 to 1.6 in all of toner particles is 65% by number or more, a variation coefficient of a shape coefficient is 16% or less and a number variation coefficient in a number particle size distribution is 27% or less.

9. The toner of claim 1, wherein the Feret's average horizontal diameter of the colorant is from 50 nm to 300 nm, a ratio of the colorant having the Feret's horizontal diameter of from 2 nm to 300 nm is 60% by number or more and a variation coefficient of the Feret's horizontal diameter of the colorant is 40% or less.

10. The toner of claim 1, wherein either of $Ri_a$ and Rib is a hydrogen atom and the other is an ethyl group, and either of R2a and R2b is a hydrogen atom and the other is an ethyl group in the General Formula (1).

11. The toner of claim 1, wherein R3 and R4 are a methyl group in the General Formula (1).

12. The toner of claim 1, wherein R3 is a methyl group and R4 is a methyl group on a 3'-position.

13. The toner of claim 1, wherein content of the compound represented by General Formula (1) in the colorant is from 30% by mass to 100% by mass.

14. The toner of claim 1, further comprising a crystalline material having a melting point of 50° C. to 130° C.

15. A method for producing the toner of claim 1, comprising: producing the binder resin by polymerizing polymerizable monomers in an aqueous medium.

16. An image forming method comprising: visualizing an electrostatic latent image formed on a photoreceptor, with the toner of claim 1; transferring the visualized image onto a recording medium; and carrying out a heat fixation of the transferred image.

17. The method of claim 16, wherein the heat fixation is performed by a fixing device having an endless belt-shaped film.

18. The method of claim 17, wherein the electrostatic latent image is formed by a digital image exposure irradiation on a photoreceptor.

19. The method of claim 17, wherein the toner comprises the toner particles having a domain-matrix structure constructed by the binder resin and the colorant, wherein an average area of Voronoi polygons formed by a perpendicular bisecting line between centers of gravity of adjacent domains in the toner particle is from 20,000 $nm^2$ to 120,000 $nm^2$ and a variation coefficient of the area of the Voronoi polygons is 25% or less.

20. The method of claim 19, wherein Feret's average horizontal diameter of the colorant is from 50 nm to 300 nm, a ratio of the colorant having the Feret's horizontal diameter of from 2 nm to 300 nm is 60% by number or more and a variation coefficient of the Feret's horizontal diameter of the colorant is 40% or less.

* * * * *